US005673584A

United States Patent [19]

Kuroda et al.

[11] Patent Number: 5,673,584

[45] Date of Patent: Oct. 7, 1997

[54] METHOD OF AND AN APPARATUS FOR PRODUCING WIRE

[75] Inventors: Kouichi Kuroda, Takatsuki; Kazuyuki Nakasuji, Nishinomiya; Itsushi Iio; Shigeharu Ochi, both of Niihama, all of Japan

[73] Assignees: Sumitomo Metal Industries, Ltd., Osaka; Sumitomo Heavy Industries, Ltd., Tokyo, both of Japan

[21] Appl. No.: 440,498

[22] Filed: May 15, 1995

Related U.S. Application Data

[63] Continuation of Ser. No. 897,981, Jun. 15, 1992, abandoned.

[30] Foreign Application Priority Data

| | | | |
|---|---|---|---|
| Jun. 21, 1991 | [JP] | Japan | 3-055638 U |
| Sep. 5, 1991 | [JP] | Japan | 3-254344 |
| Nov. 8, 1991 | [JP] | Japan | 3-321428 |
| Jan. 28, 1992 | [JP] | Japan | 4-038667 |

[51] Int. Cl.[6] ..... B21B 13/12

[52] U.S. Cl. ..... 72/235; 72/11.5; 72/366.2

[58] Field of Search ..... 72/14, 19, 28, 72/148, 205, 224, 225, 234, 235, 249, 8.8, 11.5, 366.2; 140/2; 242/75.5, 78.6, 78.8

[56] References Cited

U.S. PATENT DOCUMENTS

| | | | |
|---|---|---|---|
| 2,094,920 | 10/1937 | Inslee | 72/224 |
| 2,739,763 | 3/1956 | Silfverlin et al. | 242/78.1 |
| 3,028,114 | 4/1962 | Asbeck | 72/14 |
| 3,042,333 | 7/1962 | Wilder, Jr. | 242/75.5 |
| 3,153,954 | 10/1964 | Blair | 72/234 |
| 3,355,923 | 12/1967 | Gillet | 72/224 |
| 3,513,679 | 5/1970 | Dechene et al. | 72/234 |
| 3,518,857 | 7/1970 | Hancock et al. | 72/14 |
| 3,756,059 | 9/1973 | Krafft et al. | 72/235 |
| 3,831,412 | 8/1974 | Bravin | 72/19 |
| 4,019,360 | 4/1977 | Biernot et al. | 72/249 |
| 4,191,041 | 3/1980 | Braver et al. | 72/235 |
| 4,229,961 | 10/1980 | Vydrin et al. | 72/235 |
| 4,355,526 | 10/1982 | Miles | 242/78.8 |

FOREIGN PATENT DOCUMENTS

| | | | |
|---|---|---|---|
| 149486 | 6/1949 | Australia . | |
| 0 016 287 | 10/1980 | European Pat. Off. . | |
| 2312307 | 12/1976 | France | 72/235 |
| 2 025 640 | 12/1970 | Germany . | |
| 1652548 | 5/1973 | Germany | 72/234 |
| 59-064116 | 4/1984 | Japan . | |
| 59-169618 | 9/1984 | Japan . | |
| 0076702 | 4/1988 | Japan | 72/234 |
| 63-168202 | 7/1988 | Japan . | |
| 1-202302 | 8/1989 | Japan . | |
| 1-210102 | 8/1989 | Japan . | |
| 3-6841 | 1/1991 | Japan . | |
| 875372 | 8/1961 | United Kingdom . | |

*Primary Examiner*—Lowell A. Larson
*Assistant Examiner*—Ed Tolan
*Attorney, Agent, or Firm*—Burns, Doane, Swecker & Mathis, LLP

[57] ABSTRACT

A method of and an apparatus for rolling a rod as a starting material and producing a wire of 5 mm or smaller diameter, the method and apparatus using a continuous rolling mill comprising a plurality of round-grooved four-roll stands arranged in tandem, wherein the grooved four-roll is displaced between adjacent rolling stands by 45 degrees relative to each other around the pass line and the center-to-center distance between adjacent rolling stands measured in the pass line direction is not greater than 50 times the diameter of the rod. The front end portion of the rod is fed at slow speed into the continuous rolling mill, the front end portion being guided by a front pipe to the center of the round groove, and the front end portion is wound on a coiler. After that, the rotation speed of the grooved rolls in each rolling stand is so set as to prevent slack in the rod passing through the continuous rolling mill, and the rod is rolled at high speed, without causing the rod to touch the leading pipe, to produce a wire. Each of the rolling stands that constitute the continuous rolling mill is movable in a direction perpendicular to the pass line, each rolling stand being moved for connection to or disconnection from the driving source.

16 Claims, 28 Drawing Sheets

(φ5.5→φ2.4)

(φ5.5→φ3.0)

METHOD OF AND AN APPARATUS FOR PRODUCING WIRE

This application is a continuation of application Ser. No. 07/897,981, filed Jun. 15, 1992, now abandoned.

BACKGROUND OF THE INVENTION

1. Field of the Invention

The present invention relates to a method of and an apparatus for producing a wire of 5 mm or smaller diameter.

2. Description of Related Art

In the production of 5 mm or smaller diameter wire of steel or other metal, a billet as the starting material is first hot-rolled by a rod rolling process comprising a set of roughing mill blocks, a set of intermediate mill blocks, and a set of finishing mill blocks, to produce a rod of diameter larger than 5.5 mm; the resulting rod is then drawn through a series of dies to reduce its diameter gradually. Means for gradually reducing the rod diameter include, for example, the method and apparatus disclosed in the Japanese Patent Application Laid-Open No. 63-168202 which has previously been filed by the present inventors.

FIG. 1 is a schematic side view of the prior art wire producing apparatus disclosed in the Japanese Patent Application Laid-Open No. 63-168202. The construction of the apparatus is such that a plurality of rolling stands 40 each having a plurality of grooved rolls are arranged in tandem to construct a continuous rolling mill 4, with an uncoiler 1 having a rod coil W thereon being disposed at the entry coiler side of the continuous rolling mill 4 and with a coiler 6 on which the rolled wire SW is taken up being disposed at the exit side thereof. First, the front end of the rod W is threaded through the continuous rolling mill 4 at slow speed and attached to the coiler 6, and then, the rod W is rolled at high speed through the continuous rolling mill 4, the resulting wire SW being taken up on the coiler 6. The coiler 6 controls the tension of the wire SW according to the rolling speed of the continuous rolling mill 4 in order to prevent slack in the wire SW being taken up. The wire SW is wound up and piled up on the coiler 6 orderly to permit rolling at high speed. This production method is characterized in that the groove shape of the grooved rolls is round and in that the rolls are arranged so that unrestrained portions between adjacent groove rolls of the roll grooves do not coincide between adjacent rolling stands 40.

The above method not only serves to facilitate the rolling of 5 mm or smaller diameter wires, which has been believed not possible with conventional rolling, but also allows rolling at high speed; the effect of this is the realization of the production speed that far exceeds that of the conventional wire drawing process commonly used for the production of wire. Furthermore, the application of tension by the coiler 8 serves to enhance the dimensional accuracy of wire rolled by the continuous rolling mill 4.

However, according to additional tests conducted by the present inventors, it has been found that in the production of wire of further smaller diameter the rolled wire is twisted between adjacent rolling stands 40 and the unrestrained portions between adjacent rolls of the roll grooves coincide from one rolling stand to the next, causing the rolled wire to be protruded out of the grooved rolls and thus preventing the production of wire SW with good dimensional accuracy.

Furthermore, in the prior art apparatus, since the plurality of rolling stands 40 are mounted in line on the base and clamped in place in the horizontal direction (pass line direction) with the rolling stands assembled relative to each other, even a slight change in the final size of the wire SW to be produced necessitates removing all the rolling stands 40 and reassembling them in order after adding or removing one or more rolling stands 40 at the downstream end, which is disadvantageous from the viewpoint of work efficiency.

Also, in order to achieve a reduction in the size of the continuous rolling mill 4, a common driving method is usually employed as a method to drive the rolls, in which the input shafts of the rolling stands 40 are driven by a single driving source (motor), and gear ratio of rolling stands 40 are fixed. Since the finishing stands in the continuous rolling mill 4 provide only a small amount of reduction in area of rolling, the common driving method requires that the finishing stands should always be placed at the same downstream end, the resulting problem being a limited degree of freedom in the arrangement of the rolling stands 40.

Another problem is that when the entire length of coil has been delivered out of the uncoiler 1 and the tail end of the rod W, i.e. the tail end of the wire SW, has been issued from the continuous rolling mill 4, the tension applied to the wire SW is abruptly released at that moment, causing the wire SW coiled on the coiler 6 to be unwound starting from the tail end thereof.

Furthermore, since connection and disconnection of each rolling stand 40 to and from the driving source are accomplished by moving a coupling connected to the driving source and engageable to and disengageable from the roll shaft, there is a limit to the reduction in the coupling length. The resulting problem is that the rolling speed cannot be increased since higher speed rotation of the grooved rolls induces severe vibrations in the coupling, when there is no rolling stand and the coupling is in cantilever condition.

SUMMARY OF THE INVENTION

As described above, the method and apparatus disclosed in the Japanese Patent Application Laid-Open No. 63-168202 has various problems that need resolving, and the present invention has been devised to overcome these problems.

Thus, it is an object of the present invention to provide a wire producing method and apparatus capable of producing a wire of 5 mm or smaller diameter with good accuracy.

It is another object of the invention to provide a wire producing method and apparatus whereby rolling stands can be readily changed and the number of rolling stands can be readily increased or decreased when, for example, the finishing size of the wire is to be changed.

It is a further object of the invention to provide a wire producing method and apparatus whereby the peripheral speed of the grooved rolls of a finishing stand, wherever mounted, is matched with the wire speed for smooth rolling operation thereby ensuring the production of wire having a smooth surface.

It is a still further object of the invention to provide a wire producing method and apparatus which permit high speed rolling and which allow a higher degree of freedom in the setting of rolling conditions.

It is a yet further object of the invention to provide a wire producing method and apparatus whereby the wire coiled on a coiler is prevented from unwinding and whereby the tail end of the wire is wound in an orderly manner following the curvature of the coil.

According to the present invention, a continuous rolling mill is used to roll a rod as a starting material and produce a wire of 5 mm or smaller diameter, the continuous rolling mill comprising a plurality of round-grooved four-roll stands arranged in tandem with the bottom position of the roll groove being displaced between adjacent rolling stands by 45 degrees relative to each other around the pass line and with the center-to-center distance between adjacent rolling stands measured in the pass line direction being chosen not greater than 50 times the average diameter of the rod (material to be rolled) passing therethrough. First, the front end portion of the rod is fed at slow speed into the continuous rolling mill, the front end portion being guided by a leading pipe to the roll groove center, and then, the front end portion of the wire is pinned to a coiler. Thereafter, the rotation speed of the grooved rolls in each rolling stand is so set as to prevent slack in the rod during rolling through the continuous rolling mill, and the rod is fed at high speed through the continuous rolling mill, without causing the rod to touch the inside wall of the leading pipe, to produce a wire.

In a preferred mode of the invention, all the rolling stands are driven together during the time that the front end portion of the rod is being fed while being guided by the leading pipe to the roll groove center, until the front end portion of the wire is pinned to the coiler; thereafter, only the finishing stand is put in a non-driven condition and is thus allowed to rotate to roll the rod to the finished size as the rod is passed therethrough.

In another preferred mode of the invention, each of the rolling stands that constitute the continuous rolling mill is movable independently in a direction perpendicular to the pass line, each rolling stand being moved for connection to or disconnection from the driving source.

In a further preferred mode of the invention, the rolling stands are clamped together from the downstream side in the pass line direction, and when changing the final rolled size of the wire, rolling stands are changed and/or added or removed at the downstream side.

In a still further preferred mode of the invention, the wire wound on the coiler is pressed by a pressure roller from the outer surface thereof with the timing related to the rolling of the tail end of the rod being completed in the pass line (e.g., the timing that the tail end of the rod passes a predetermined position in the pass line, or the timing that the coil diameter on an uncoiler is reduced below a predetermined dimension).

In a yet further preferred mode of the invention, there is provided a mechanism that continues to apply tension to the wire even after the tail end of the wire is issued from the continuous rolling mill.

The above and further objects and features of the invention will more fully be apparent from the following detailed description with accompanying drawings.

DESCRIPTION OF THE PREFERRED EMBODIMENTS

The preferred embodiments of the present invention will now be described in detail with reference to the accompanying drawings.

(Embodiment 1)

Figure 1:
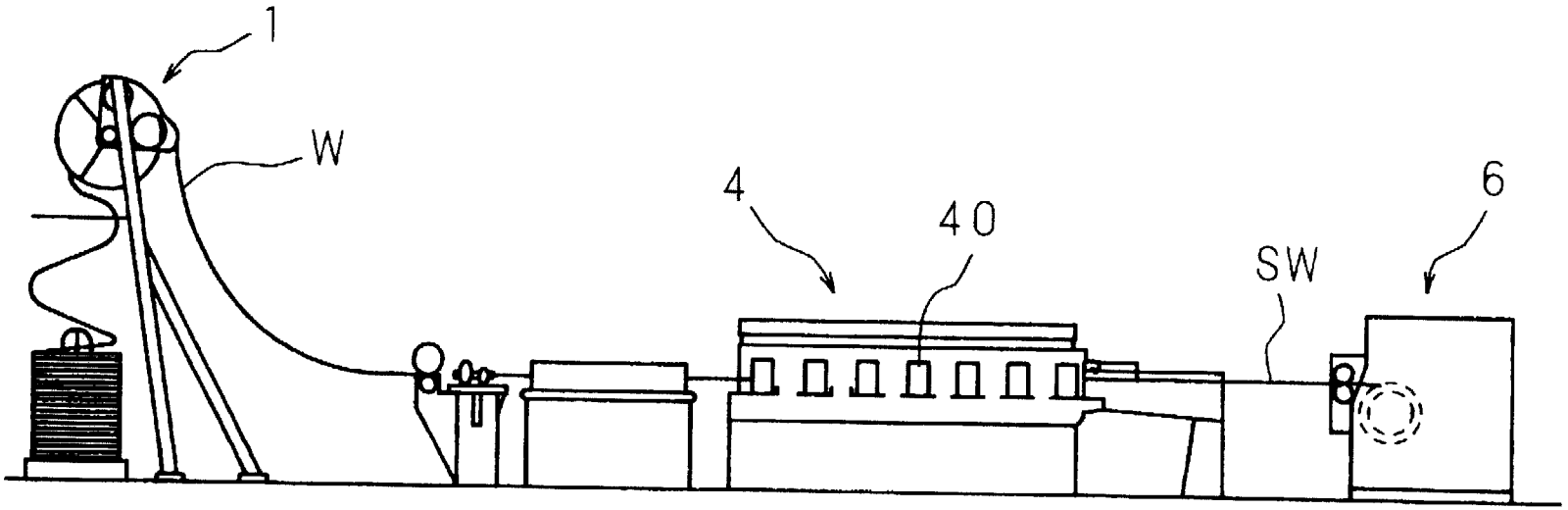
Fig. 1 Prior Art
FIG. 1 is a schematic side view of a prior art wire producing apparatus.
Figure 2:
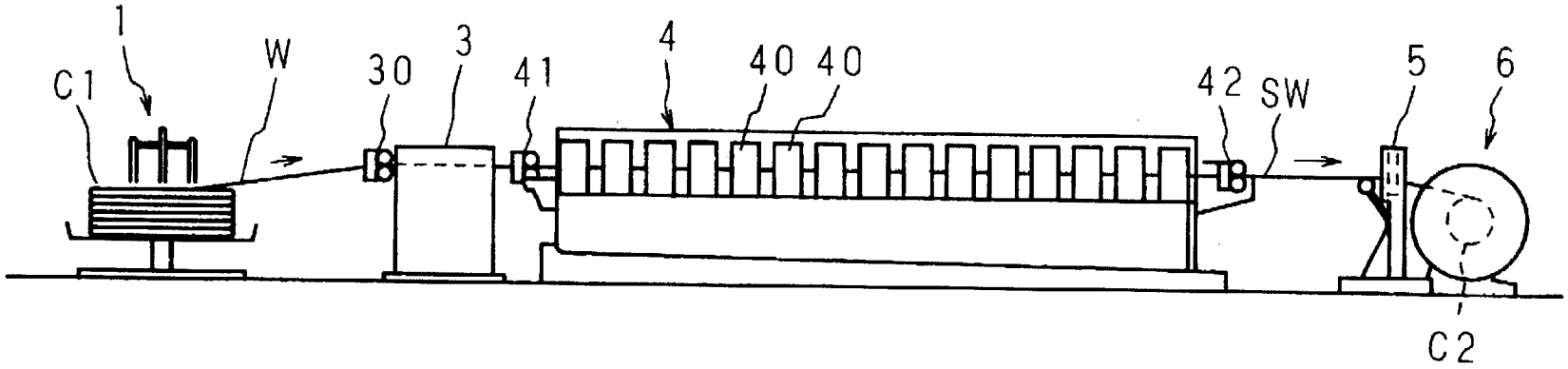
FIG. 2 is a schematic side view of a wire producing apparatus according to a first embodiment of the present invention.

FIG. 2 is a schematic side view of a wire producing apparatus according to a first embodiment. At the upstream end of the wire producing apparatus, there is disposed a turntable-type horizontal uncoiler 1 on which a coil rod W is laid. A straightener 3 having a guide roller 30 at its entry side is disposed on the downstream side of the uncoiler 1, so that the rod W delivered from the uncoiler 1 is straightened up through the straightener 3. Disposed on the downstream side of the straightener 3 is a continuous rolling mill 4 having guide rollers 41, 42 respectively at its entry and delivery sides. The continuous rolling mill 4 comprises a plurality of rolling stands 40, 40, . . . arranged in tandem, each rolling stand 40 having four rolls with a round groove as will be described later. The grooved rolls in the rolling stands 40, 40, . . . are arranged in such a manner that unrestrained portions between adjacent groove rolls of the roll grooves do not coincide between adjacent rolling stands 40. The rod W fed through the straightener 3 is continuously rolled to produce a wire SW. On the downstream side of the continuous rolling mill 4, there is disposed a vertical cooler 6 that takes up the wire SW through a swing roller 5, a traversing mechanism for normal winding of the wire SW in order. The swing roller 5 moves right or left in a horizontal plane according to the rotating speed of the coiler 6, considering the diameter of the wire SW, so that the wire SW is wound up and piled up on the coiler 6 orderly.

Figure 3:
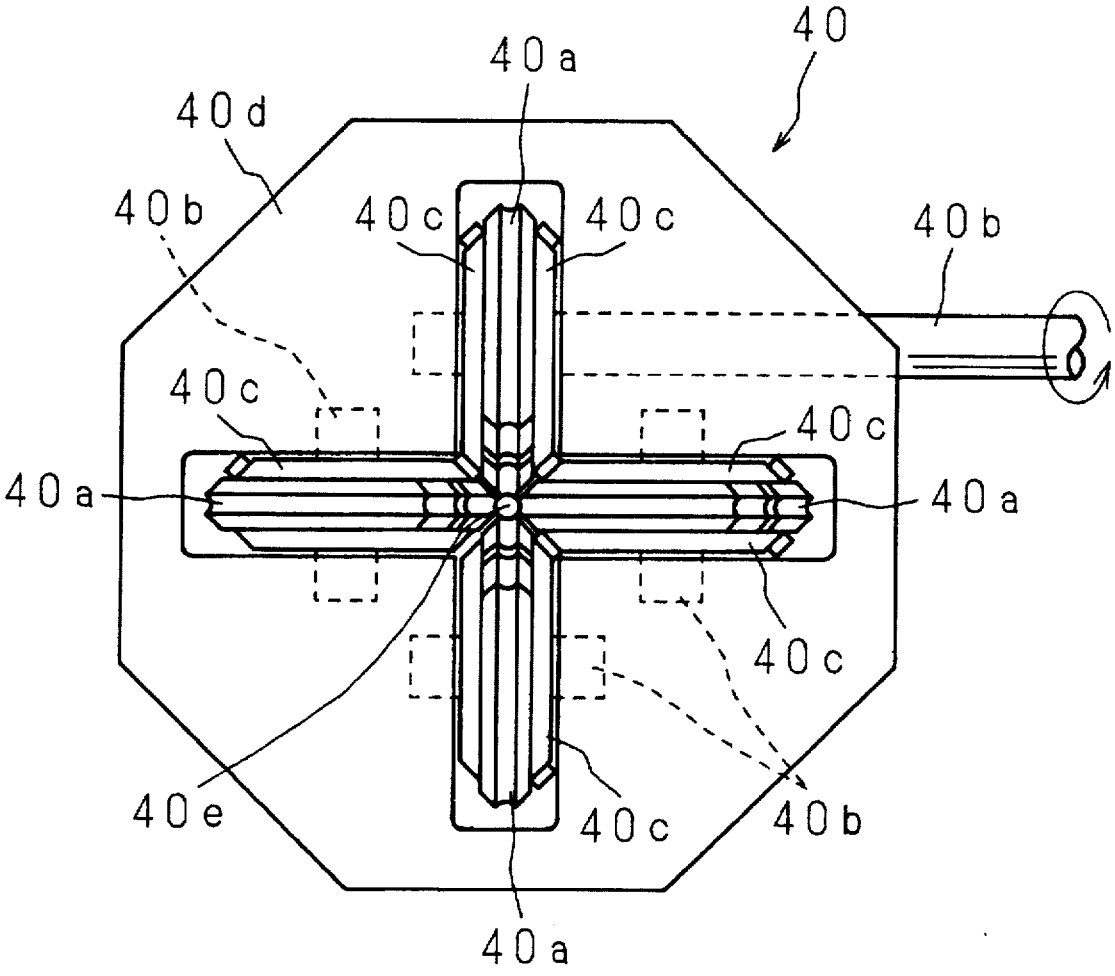
FIG. 3 is an enlarged front view showing the construction of a rolling stand in FIG. 2.

FIG. 3 shows the construction of one of the rolling stands 40. In a housing **40*d* having an octagonal shape viewed from the front, there are formed a horizontal and a vertical opening intersecting each other at right angles at the center of the housing 40*d*. Supported in the respective sections of the openings are four grooved rolls 40*a*, 40*a*, 40*a*, 40*a* with their roll shafts 40*b*, 40*b*, 40*b*, 40*b* inserted into holes formed in the walls of the openings. One end of the roll shaft 40*b* of one of the grooved rolls 40*a* serves as an input shaft which is connected to a driving source (not shown) to drive this grooved roll 40*a*. The driving force is transmitted to each of the other three grooved rolls 40*a*, 40*a*, 40*a* via a bevel gear 40*c* attached to each side thereof. The grooves of the four grooved rolls 40*a* together form a round groove 40*e* at the center of the housing 40*d***, through which the rod W is fed and rolled.

Figure 4A:
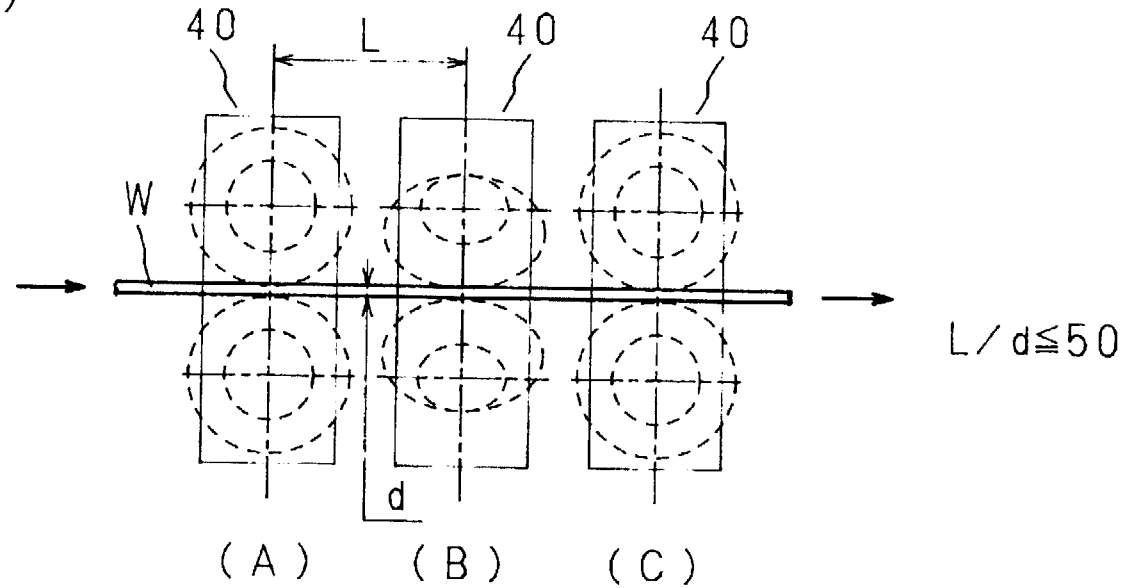
FIGS. 4*a* and 4*b* illustrate the arrangement of the rolling stands shown in FIG. 2.
Figure 4B:
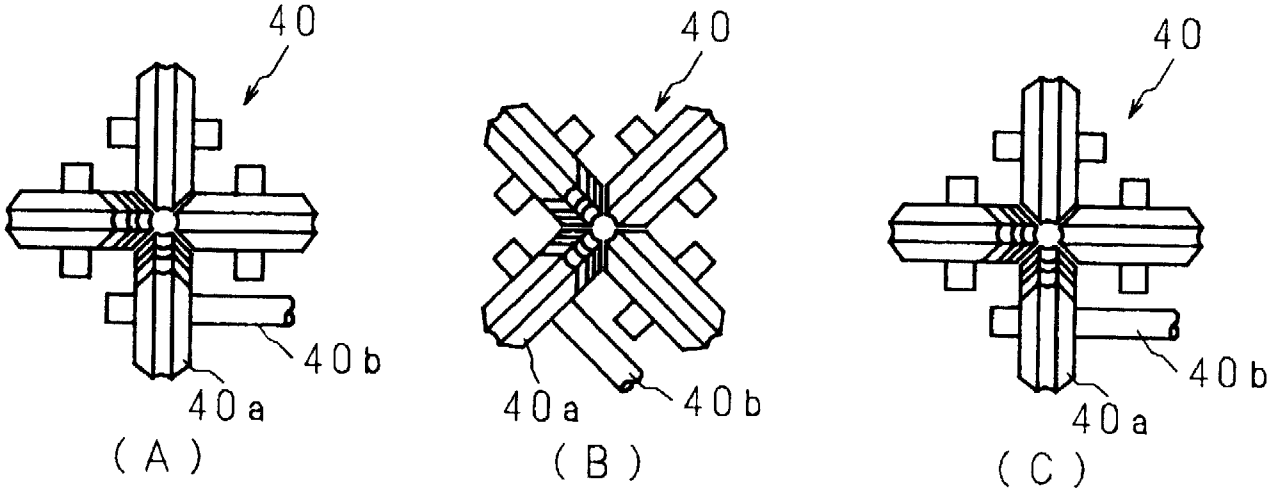
Figure 5:
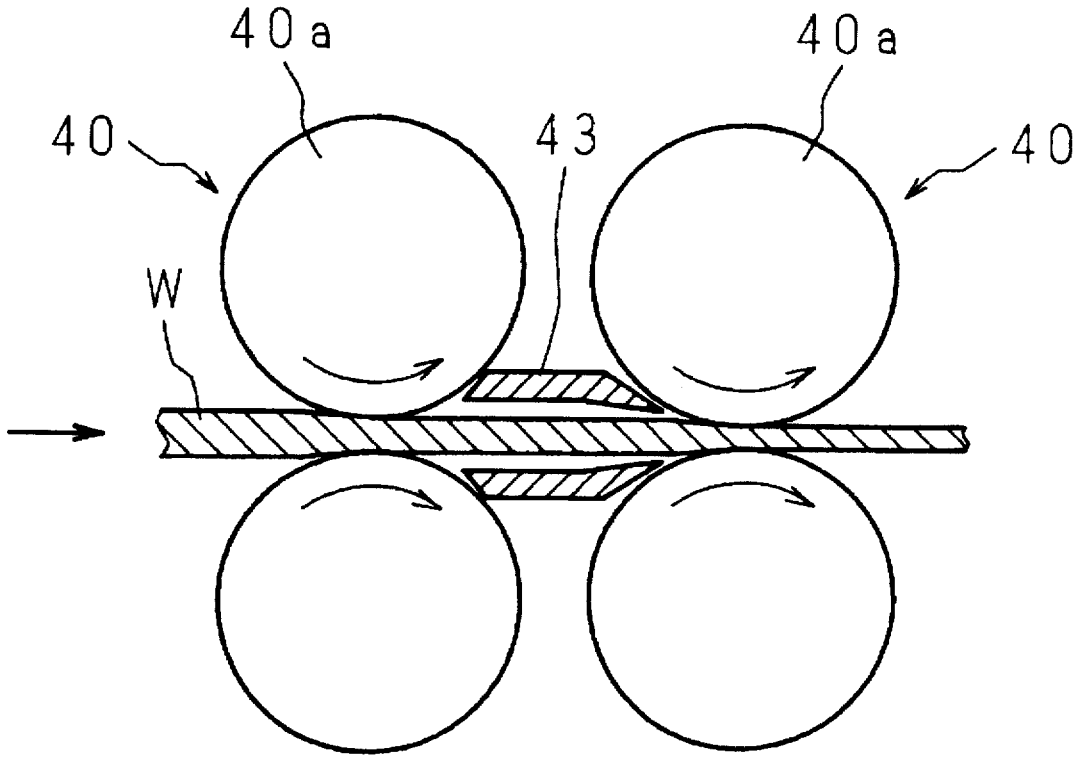
FIG. 5 is an enlarged sectional view showing a portion of FIG. 2.

The plurality of rolling stands 40 having the identical construction are arranged in tandem in the pass line direction, as shown in FIG. 4(*a*). In FIG. 4(*a*), (A) and (C) each designate a horizontal stand, and (B) designates a 45-degree inclined stand. FIG. 4(*b*) shows the arrangement of rolls in the respective stands. As shown, the continuous rolling mill 4 is constructed by alternately arranging the horizontal and inclined stands 40, the bottom position of the round groove **40*e* being displaced, between adjacent rolling stands 40 and 40, by 45° around the pass line. The center-to-center distance L between adjacent rolling stands 40 and 40 is set at a value not greater than 50 times the diameter d of the rod W that is passed therethrough. Furthermore, as shown in FIG. 5, there is provided a cylindrical leading pipe 43 between adjacent rolling stands 40 and 40. The inside diameter of the leading pipe 43** is slightly larger than the diameter of the rod W passing therethrough.

Next, the wire producing operation of the apparatus will be described. First, the rod W unwound from a coil C1 loaded on the uncoiler 1 is fed to the straightener 3 via the guide roller 30, and after straightening, the rod W is delivered to the entrance of the continuous rolling mill 4. The continuous rolling mill 4 is operated at slow speed so that the rod W is rolled therethrough while being guided by the leading pipes 43 until it is transported to the exit of the continuous rolling mill 4. The front end portion of the wire SW that has reached the exit of the continuous rolling mill 4 is fed via the swing roller 5 to the coiler 8 which takes up thereon the front end portion of the wire SW. After the threading from the uncoiler 1 to the coiler 6 has been completed, the continuous rolling mill 4 is operated at high speed for high speed rolling operation. The rod W supplied from the uncoiler 1 to the continuous rolling mill 4 is gradually reduced in diameter through the successive rolling stands 40 to produce the wire SW of the desired size. The wire SW is wound around the coiler 6, thereby forming a coil C2 of the wire SW.

After the threading is completed, the rod W is centered in the pass line by the slight tension acting between each rolling stand 40; therefore, there is no possibility of the rod W coming into contact with the leading pipes 43 during high speed rolling. Furthermore, since the rod W is restrained by the round groove **40*e* and since the center-to-center distance between adjacent rolling stands 40 is set at a value not greater than 50 times the rod diameter, the rod W is prevented from twisting or slacking between adjacent rolling stands 40**. This ensures the production of the wire SW with high efficiency and good accuracy.

The following describes specific examples of wire producing in which wires were produced in accordance with the first embodiment.

Using 24 rolling stands each attaining a 10% reduction in cross sectional area per pass, a rod of pure titanium (diameter 5.5 mm) as a starting material was rolled cold to produce a wire of 1.6 mm diameter (example 1). Also, a rod of the same material was rolled hot at 850° C. to produce a wire of the same diameter as the first example (example 2). The following production conditions were used for both examples 1 and 2.

Center-to-center distance between adjacent rolling stands: 80 mm, Diameter of grooved roll: 80 mm, Type of rolling stand: Four-roll stand, Type of groove: Round groove In both examples, no flaws were observed on the surface of the produced wire, and several tons of material was able to be rolled without causing twisting in the rod between adjacent roll stands, the dimensional accuracy of the produced wire being 1.6±0.015 mm (in example 1) and 1.6±0.03 mm (in example 2).

As a comparative example, a production experiment was informed using the same conditions as above except that the center-to-center distance between adjacent rolling stands was increased to 120 mm. In this experiment, the rod was twisted between adjacent roll stands and the rolled rod was protruded to gap of groove rolls, that is, the unrestrained portion between adjacent groove rolls when its diameter was reduced below 2.4 mm, and out of five coils (200 kg per coil), the rolling of three coils failed.

Furthermore, using 24 rolling stands each attaining a 10% reduction in cross sectional area per pass, a rod of stainless steel (SUS 304) of 5.5 mm diameter was rolled cold to produce a wire of 1.5 mm diameter. The production conditions were as follows:

Center-to-center distance between adjacent rolling stands: 80 mm, Diameter of grooved roll: 85 mm, Type of rolling stand: Four-roll stand, Type of groove: Round groove In this example also, no flaws were observed on the surface of the produced wire, and several tons of material was able to be rolled without causing twisting of the rolled rod between adjacent roll stands.

(Embodiment 2)

Figure 6:
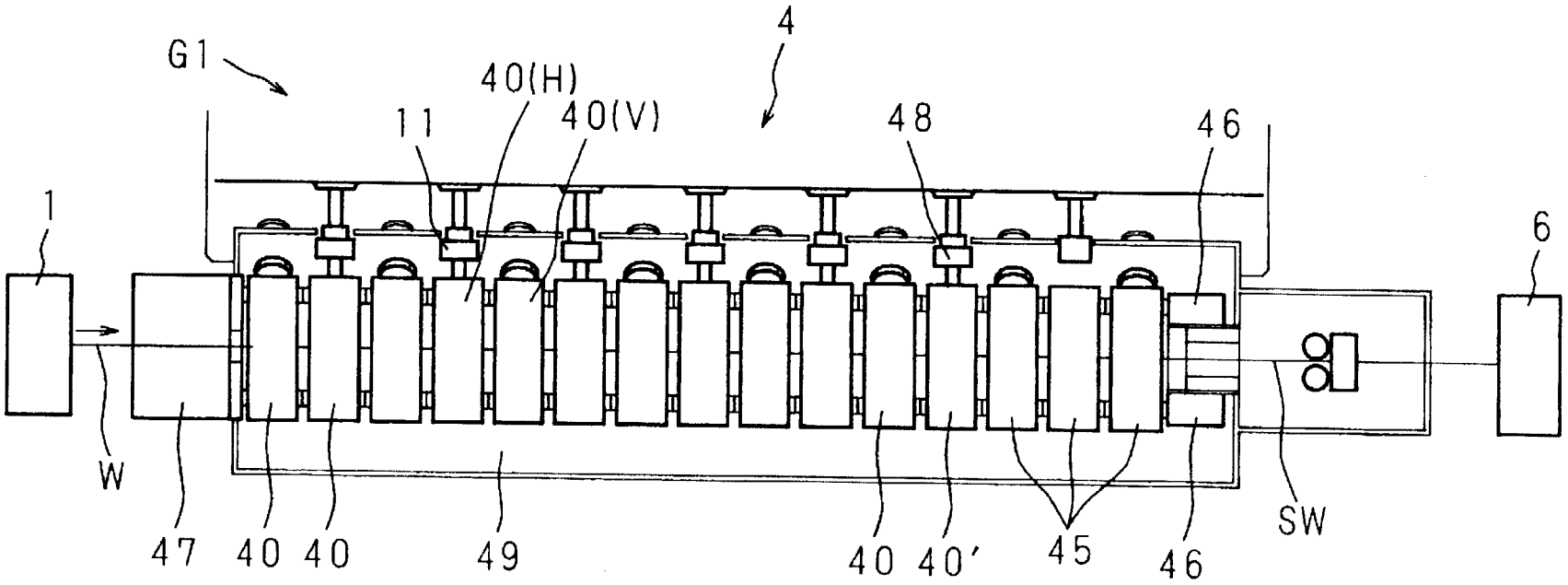
FIG. 6 is a schematic plan view of a wire producing apparatus according to a second embodiment of the present invention.

FIG. 6 is a schematic plan view of a wire producing apparatus according to a second embodiment, wherein the reference numerals 1 and 6 designate the same uncoiler and coiler as illustrated in the first embodiment. The continuous rolling mill 4 of this embodiment comprises a plurality of rolling stands 40 and a plurality of dummy blocks 45 arranged in line in this order along the pass line of the rod W, the dummy blocks 45 not being concerned to the rolling directly, the rolling stands 40 and the dummy blocks 45 being mounted on a mounting base 49 and clamped together in the horizontal direction against a fixing plate 47, disposed at the entry side, by a screw jack 46 disposed at the exit side of the rod W. As in the first embodiment, the rod W delivered from the uncoiler 1 is processed through the continuous rolling mill 4 into a wire SW of the desired cross sectional dimension, the finished wire SW then being taken up on the coiler 6. The horizontal clamp can be released in order to change the rolling stands 40 or to increase or decrease the number of rolling stands 40 by replacing one or more dummy blocks 45 with a rolling stand or stands 40 or vice versa.

From the upstream side toward the center of the continuous rolling mill 4, horizontal stands 40(H) are arranged alternately with inclined stands 40(V), as in the first embodiment, and a finishing stand 40' constructed from a horizontal stand is disposed at the final stage of the rolling stand train. Following the finishing stand 40', the plurality of dummy blocks 45 are disposed at the downstream side within the continuous rolling mill 4. The construction of each dummy block 45 is not specifically limited; a rolling stand 40 having a groove diameter larger than that of the finishing stand 40' may be used as a dummy block 45, or alternatively, a block simply having a guide roller or leading pipe rather than grooved rolls may be substituted.

Figure 7:
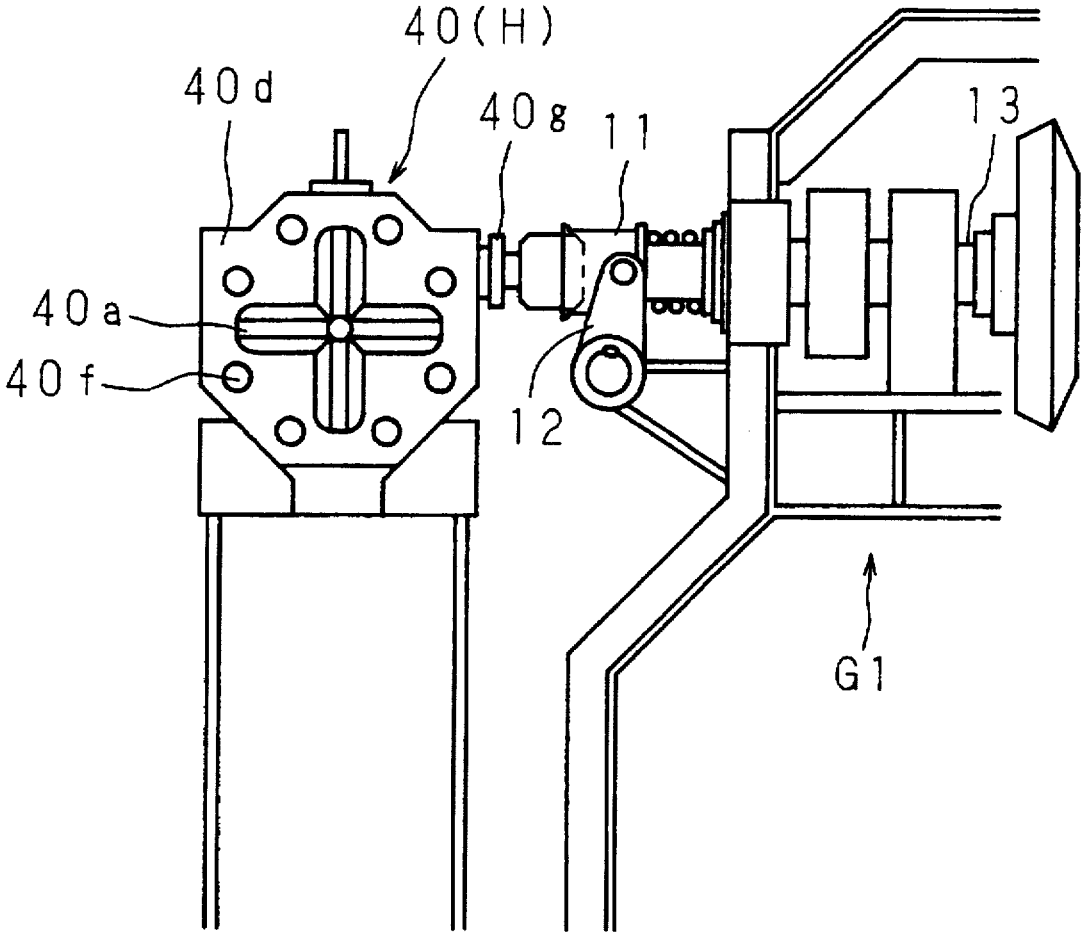
FIG. 7 is an enlarged front view of a horizontal stand shown in FIG. 8.
Figure 8:
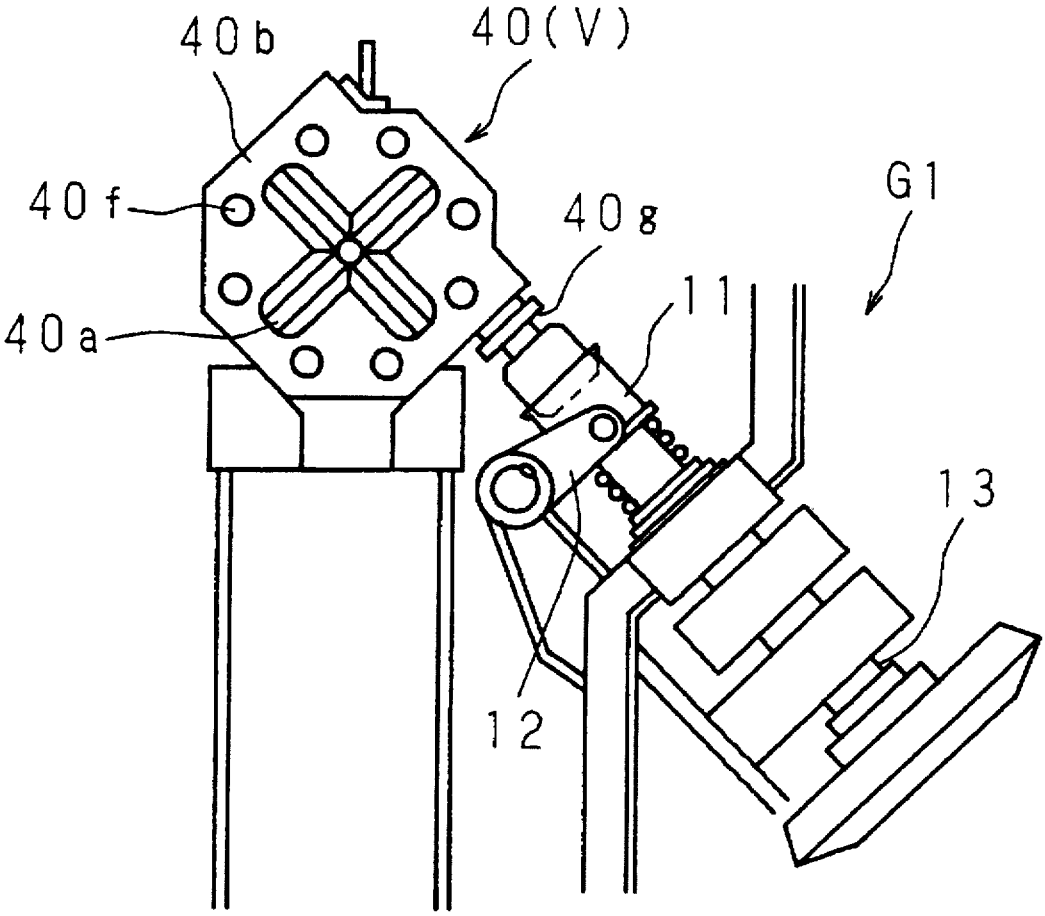
FIG. 8 is an enlarged front view of an inclined stand shown in FIG. 6.
Figure 9:
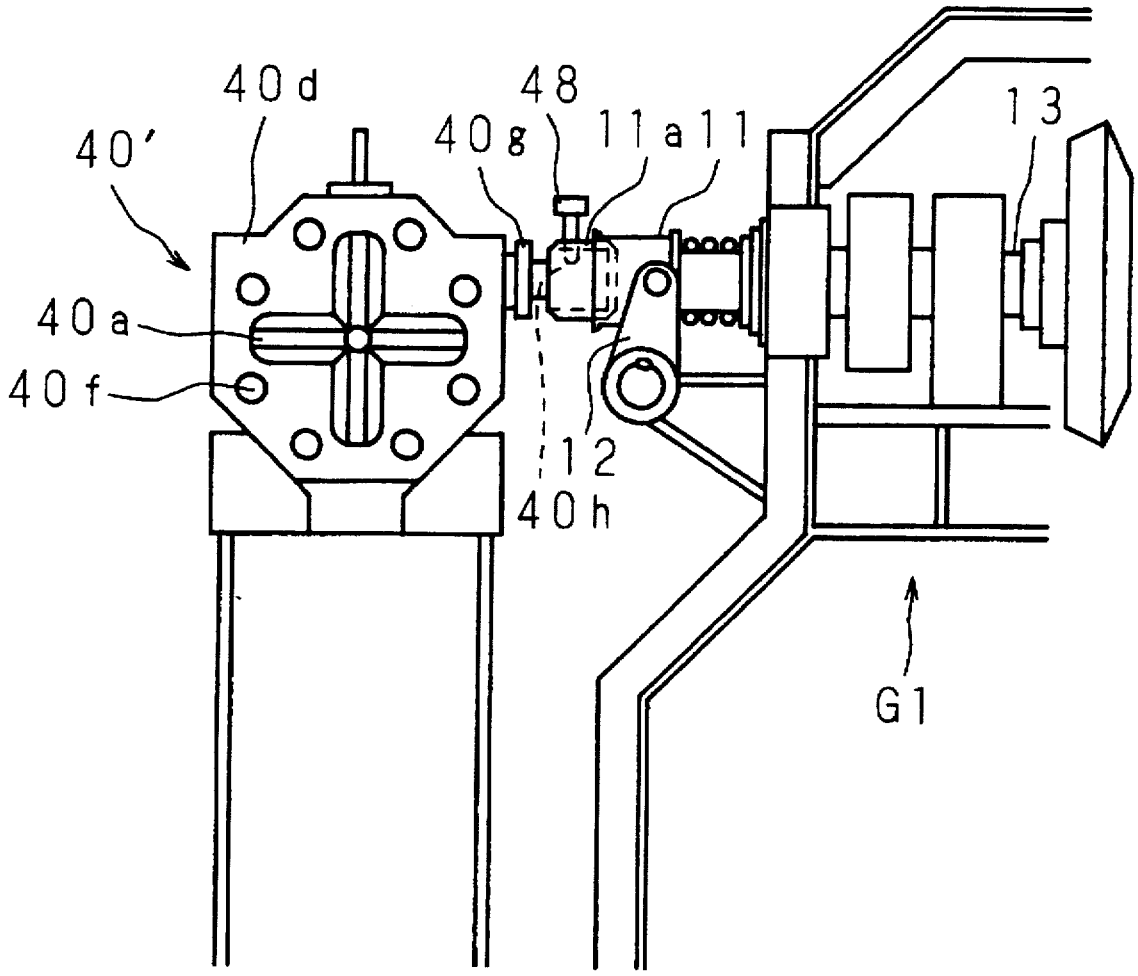
FIG. 9 is an enlarged front view of a finishing stand shown in FIG. 6.

FIGS. 7, 8, and 9 show the constructions of the horizontal stand 40(H), inclined stand 40(V), and finishing stand 40', respectively. The horizontal stand 40(H) comprises four grooved rolls 40*a* mounted in a housing 40*d* in pairs in the horizontal and vertical directions, the grooved rolls 40*a* in each pair being disposed opposite each other across the pass line. The grooved rolls 40*a* mounted in the inclined stand 40(V) are physically displaced by 45° around the pass line relative to the grooved rolls 40*a* in the horizontal stand 40(H). The housing 40*d* of each rolling stand 40 is provided with projections 40*f* on the surfaces thereof facing the adjacent rolling stands 40 or dummy blocks 45 so that the rolling stands 40 and dummy blocks 45 are clamped together with their respective projections 40*f* abutting against each other. Extending sideways from the housing 40*d* of each rolling stand 40 and facing a coupling 11 mounted on a transmission shaft 13 of a gear reducer G1 is a roll drive shaft 40*g* for driving the grooved rolls 40*a*. The coupling 11 is moved by means of a coupling shifter 12 and is made to engage the roll drive shaft 40*g* so that the output of a motor (not shown) is transmitted via the gear reducer G1 to drive the grooved rolls 40*a* for rotation.

The construction of the finishing stand 40' is different from that of other rolling stands 40 in that a connecting pin 48 is detachably inserted through the outer barrel 11*a* of the coupling 11 and reaching the inner barrel 40*h* of the roll drive shaft 40*g*, as shown in FIG. 9. With the connecting pin 48 inserted, the grooved rolls 40*a* of the finishing stand 40' are driven for rotation, but with the connecting pin 48 removed, the motor power is not transmitted to the finishing stand 40' to drive the grooved rolls 40*a* thereof. During the threading operation, all the rolling stands 40 including the finishing stand 40' with the connecting pin 48 inserted therein are driven for rotation. After the front end portion of the rod W has been attached to the coiler 6 at the completion of the threading, the connecting pin 48 is removed, and high speed rolling is started. During the high speed rolling, the torque of the coiler 6 is transmitted via the rod W to the grooved rolls 40*a* of the finishing stand 40', thus allowing them to rotate as the rod W is passed therethrough. Therefore, regardless of where the finishing stand 40' is installed in the continuous rolling mill 4, the finishing stand 40' can be connected to the output shaft of a common drive type distributing gear reducer for driving the grooved rolls 40*a* without causing any problems during the threading operation. On the other hand, during the rolling operation, since the motor torque is disconnected, the grooved rolls 40*a* of the finishing stand 40' are rotated at the surface speed that matches the rolling speed of the rod W, which prevents slippage, seizure, etc. between the rod W and the grooved rolls 40*a* and thus assures the production of a wire SW with a good surface finish.

The means for connecting the roll drive shaft 40*g* of the finishing stand 40' to the coupling 11 is not limited to the connecting pin 48, but instead, a clutch mechanism can be employed, for example. Means of any construction can be used as long as it is capable of switching on-line the finishing stand 40' between connection and disconnection.

Figure 10A:
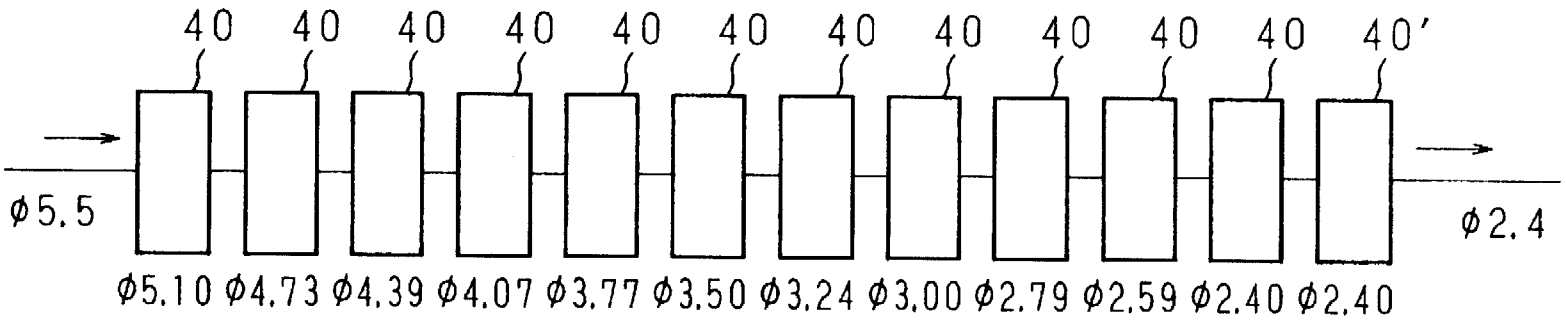
FIGS. 10*a* and 10*b* illustrate an example of how the rolling stands are changed in the second embodiment.
Figure 10B:
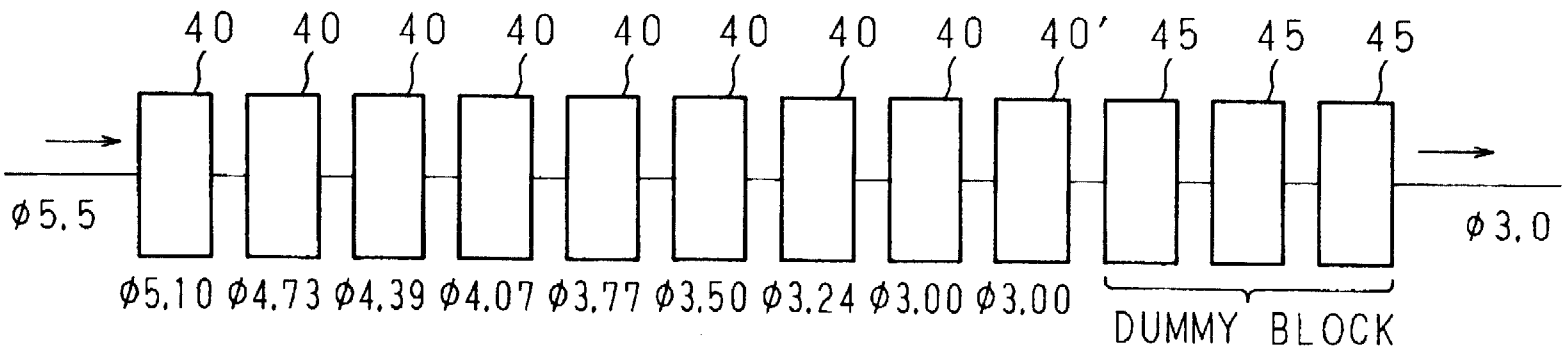

FIG. 10 illustrates an example of how the arrangement of the rolling stands 40 and dummy blocks 45 is changed. FIG. 10(*a*) shows the arrangement for processing a rod of 5.5 mm diameter into a wire of 2.4 mm, while FIG. 10(*b*) is the arrangement for processing a rod of 5.5 mm diameter into a wire of 3.0 mm diameter. In the arrangement of FIG. 10(*a*), the finishing stand 40' is placed at the final stage of the rolling stand train comprising 12 units and no dummy blocks 45 are used. If this arrangement is to be changed for the production of a final diameter of 3.0 mm, the horizontal clamp is loosened and the 9th rolling stand from the upstream end is replaced with a finishing stand 40' having a groove diameter of 3.0 mm, and three dummy blocks 45 are mounted on the downstream side thereof, as shown in FIG. 10(*b*). Thus, the rearrangement can be accomplished easily by only changing the four rolling stands at the downstream side while leaving intact the eight rolling stands 40 at the upstream side; the total number of units remains unchanged and there is no need to move the position of the screw jack, etc.

As described above, according to the second embodiment, the construction of the continuous rolling mill 4 is such that the plurality of rolling stands 40 are clamped together by pressing them from the downstream end toward the fixing plate 47 at the upstream end. Therefore, by just changing or adding or removing one or more rolling stands 40 at the downstream side, the continuous rolling mill 4 can be adapted for production of wires of various final sizes. Also, the construction greatly facilitates the rearrangement work. Furthermore, since means for connecting and disconnecting the driving force to the finishing stand 40' is provided, the grooved rolls 40*a* of the finishing stand 40' are directly driven during the threading operation, and driven via the rod W during the high speed rolling operation, preventing slippage, etc. between the rod W and the grooved rolls 40*a* and thus assuring the production of wire having a good surface finish.

(Embodiment 3)

Figure 11:
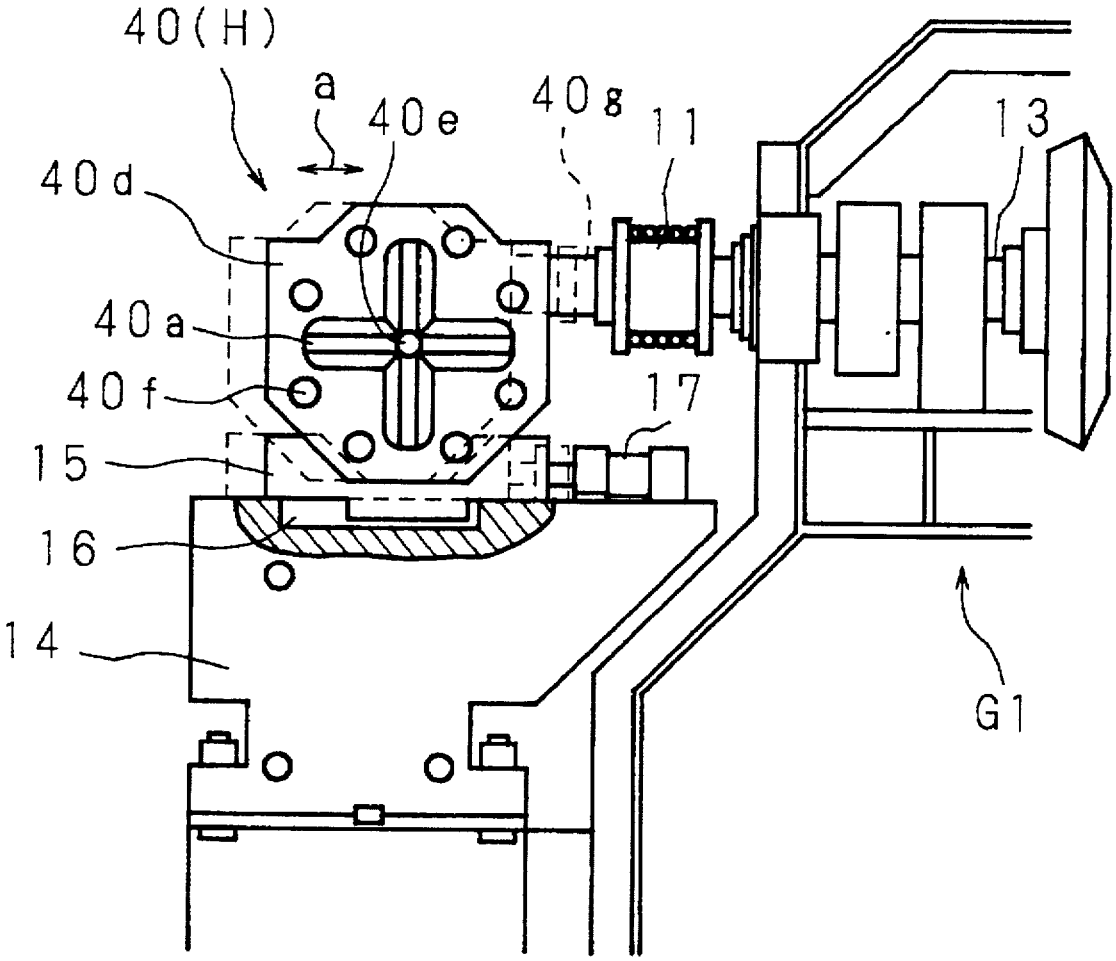
FIG. 11 is a front view of a horizontal stand in a wire producing apparatus according to a third embodiment of the present invention.
Figure 12:
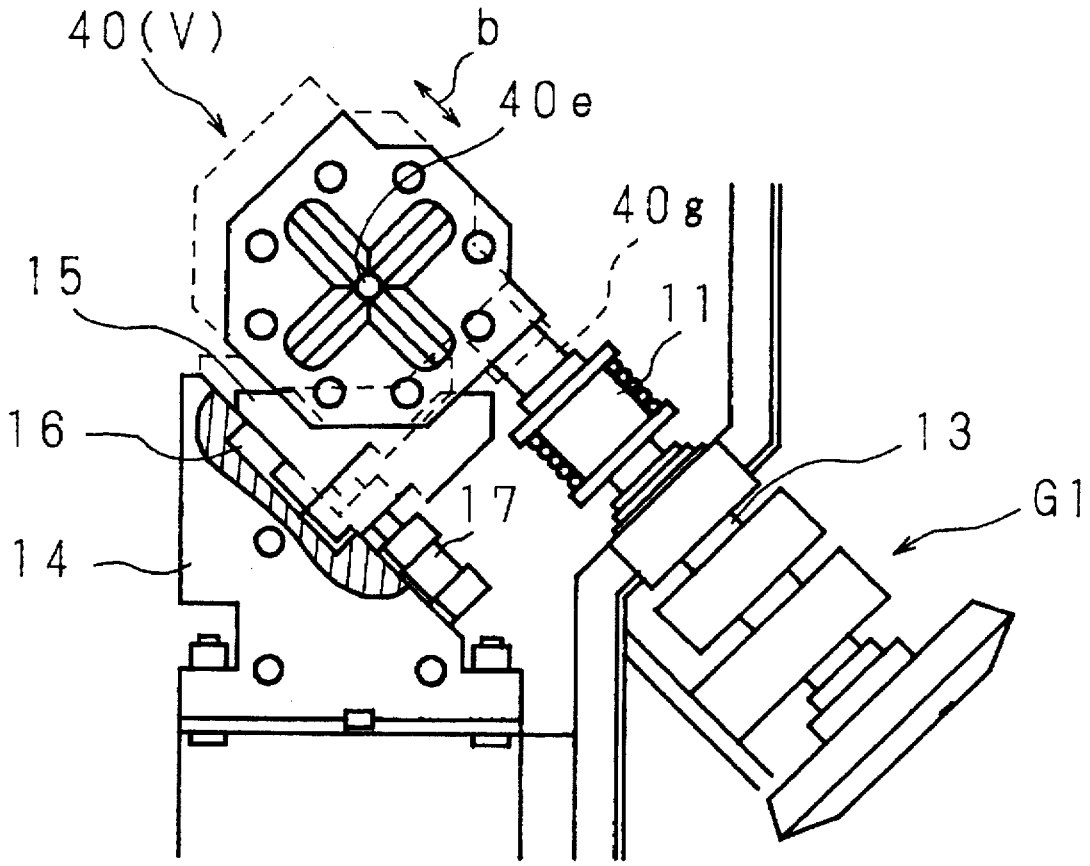
FIG. 12 is a front view of an inclined stand according to the third embodiment.

FIGS. 11 and 12 are diagrams showing the portions that characterize a third embodiment of the invention. FIG. 11 shows one of horizontal stands 40(H) arranged alternately to construct the continuous rolling mill. FIG. 12 shows one of inclined stands 40(V) arranged alternately with the horizontal stands 40(H). In the figures, the same components as in the first and second embodiments are designated by the same reference numerals, and the description thereof is omitted herein.

Referring to FIG. 11, a pedestal 15 on which the housing 40*d* of the rolling stand 40 is placed is slidably mounted on a base frame 14 via a guide way 18. The sliding direction defined by the guide way 18 is perpendicular to the pass line and parallel to the axial direction of the driving system (roll drive shaft 40*g* and transmission shaft 13 of gear reducer G1) hereinafter described. An air cylinder 17 is provided between the pedestal 15 and the base frame 14. By extending or contracting the air cylinder 17, the housing 40*d* is moved in the arrow direction a by being guided by the guide way 18. Extending from one side of the housing 40*d* is the roll drive shaft 40*g* for transmitting the rotating force to the grooved rolls 40*a*, the roll drive shaft 40*g* being disposed facing the coupling 11 mounted on the transmission shaft 13 of the gear reducer G1.

Figure 13:
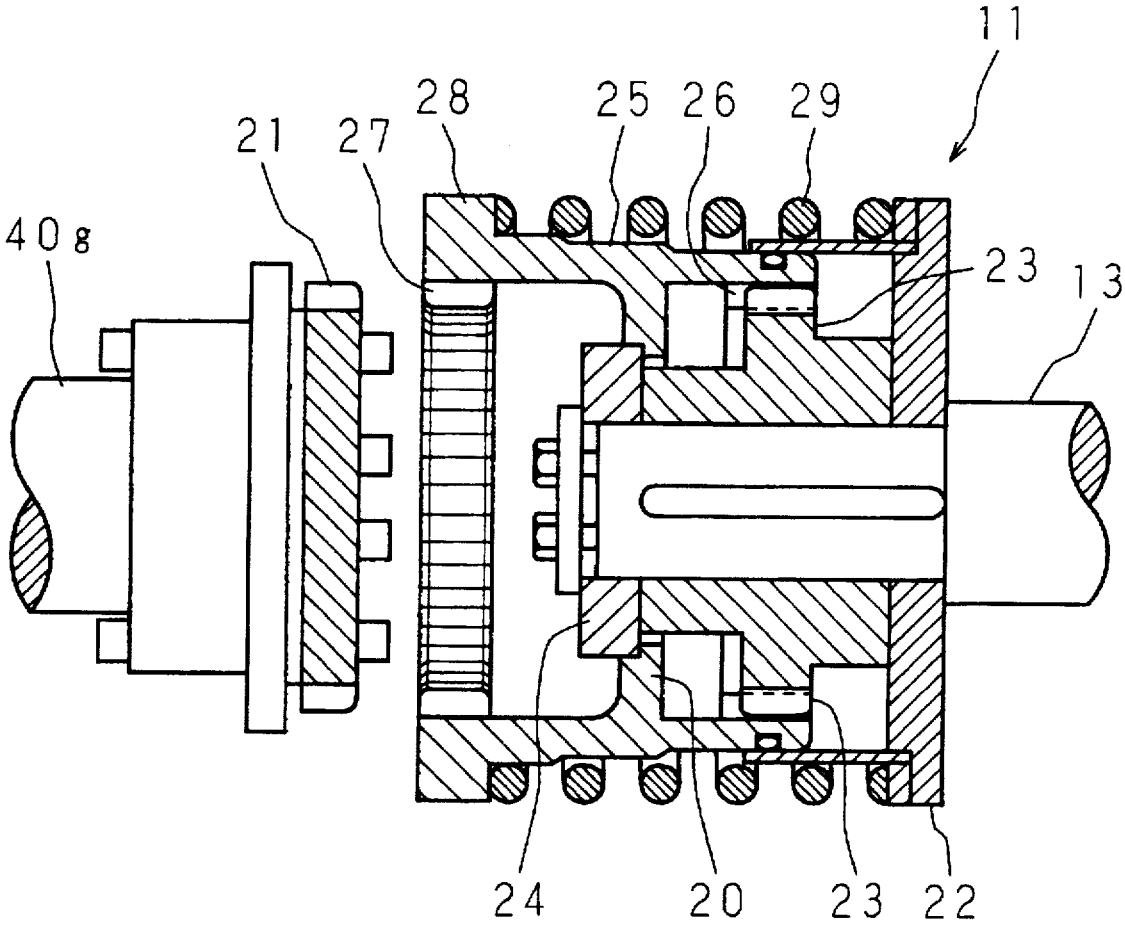
FIG. 13 is a cross sectional view showing the internal construction of a coupling shown in FIGS. 11 and 12.

FIG. 13 shows the detailed construction of the coupling 11. A flange 22, a gear 23, and a collar 24 are fixed in this order to the end portion of the transmission shaft 13, and a coupling case 25 is fitted around the outer circumferential surfaces of these parts. An internal gear 26 is formed around the right end portion of the inner circumferential surface of the coupling case 25, as shown in the figure, while an internal gear 27 is formed around the left end portion thereof. The internal gear 26 constantly engages the gear 23. A spring seat 28 is formed around the end portion of the outer circumference of the coupling case 25, and between the spring seat 28 and the flange 22, there is interposed a coil spring 29. Formed around the center portion of the inner circumferential surface of the coupling case 25 is a guide ring 20, the inner circumference of which is constantly held in contact with the outer circumference of the collar 24 by the urging force of the coil spring 29. Since the guide ring 20 is thus made to engage the collar 24, the whirling of the coupling case 25 is prevented during high speed rotation.

A gear 21 is fixed to the end of the roll drive shaft 40*g*. As the housing 40*d* is made to slide, the gear 21 on the end of the roll drive shaft 40*g* enters inside the coupling case 25 and engages the internal gear 27, thus coupling the roll drive shaft 40*g* to the transmission shaft 13. When the gear 21 is moved outside the coupling case 25, the gear 21 is disengaged from the internal gear 27, thus separating the roll drive shaft 40*g* from the transmission shaft 13. Since the roll drive shaft 40*g* and the coupling 11 are connected and disconnected by moving the roll drive shaft 40*g* back and forth with the coupling 11 staying stationary, the construction offers the feature that the barrel length of the coupling 11, particularly that of the coupling case 25, is short.

The inclined stand 40 shown in FIG. 12 is identical in construction to the horizontal stand 40 shown in FIG. 11, except that the housing 40*d* and driving system of the rolling stand 40 are tilted at an angle of 45°. Because of the inclined mounting of the stand 40, the guide way 16 formed in the base frame 14 and along which the pedestal 15 is made to slide provides a sloping surface of 45°. In this construction, the housing 40*d* is made to slide in the direction indicated by the arrow b which is perpendicular to the pass line and parallel to the roll drive shaft 40*g* and transmission shaft 13 tilted at 45°, that is, the sliding direction is tilted at 45°.

The following describes how the rolling stands 40 (housing 40*d*) are changed in the third embodiment.

In FIG. 11, the housing 40*d* in a rolling position is indicated by a solid line. From this position, the housing 40*d* is made to slide to the position indicated by a broken line when pushed by the air cylinder 17. The slide stroke needs to be set so that the projections 40*f* can be disengaged from those of the adjacent rolling stands 40 and so that the roll drive shaft 40*g* can be completely disconnected from the coupling 11. When the housing 40*d* is thus made to slide, since a gap is formed to the adjacent housing 40*d*, the desired rolling stand 40 (housing 40*d*) can be easily lifted up using a crane or the like. In the case of the inclined stand 40 shown in FIG. 12, the housing 40*d* is pushed diagonally upward by the air cylinder 17 to allow the removal of the rolling stand 40 (housing 40*d*).

To install a new rolling stand 40 (housing 40*d*), the above procedure is reversed. For example, a new housing 40*d* is lowered onto the pedestal 15 using a crane or the like, and then, the pedestal 15 is pulled to the stroke end by the air cylinder 17 to set the new rolling stand 40 (housing 40*d*) into the prescribed rolling position.

As described, according to the third embodiment, the rolling stands 40 can be changed easily. Furthermore, since the barrel length of the coupling 11 is short, the construction is resistant to vibration and suitable for high speed rotation, thus permitting high speed rolling operation.

In one modification of this embodiment, a motor may be used instead of the air cylinder 17, in which case the motor rotates a ball screw and feeds the pedestal 15 down the screw. A stopper may be provided to stop the pedestal 15 at the stroke end.

(Embodiment 4)

Figure 14:
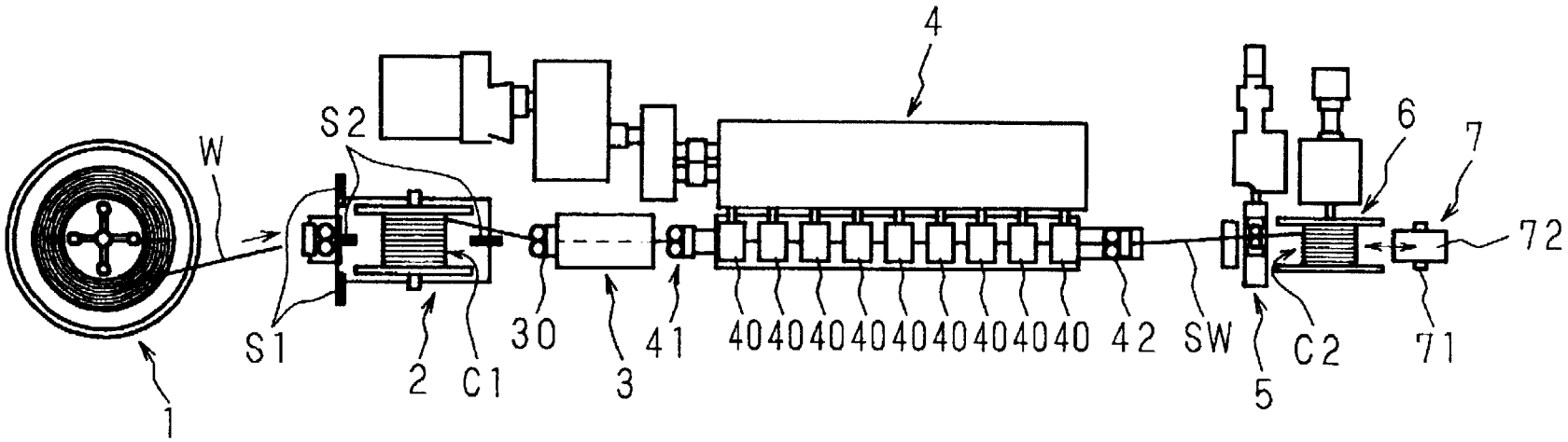
FIG. 14 is a schematic plan view of a wire producing apparatus according to a fourth embodiment of the present invention.
Figure 15:
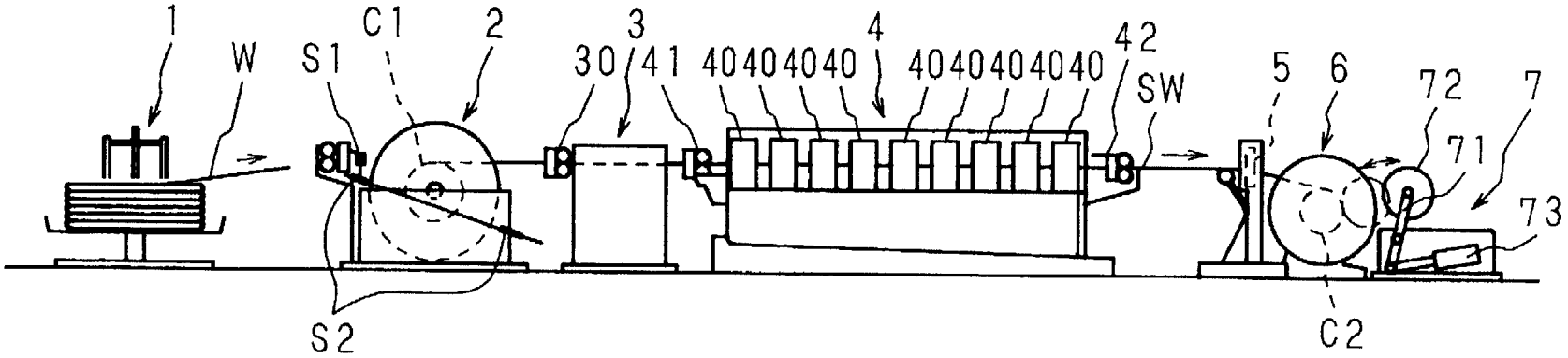
FIG. 15 is a schematic side view of the fourth embodiment.

FIGS. 14 and 15 are a schematic plan view and a schematic side view respectively, illustrating a fourth embodiment of the invention. In the figures, the same reference numerals as used in the first embodiment (FIG. 2) designate the same components. On the downstream side of the horizontal uncoiler 1, there is provided a bobbin type vertical uncoiler 2 around which the rod W delivered from the uncoiler 1 is wound orderly. The uncoilers 1 and 2 are selected for use according to the shape of the coil stock to be rolled. It will be appreciated that either uncoiler may be disposed at the upstream side. On the downstream side of the uncoiler 1, a first photoelectric sensor S1 is provided for detecting the presence of the rod W being delivered from the uncoiler 1. On the other hand, the uncoiler 2 is provided with a second photoelectric sensor S2 for detecting the remaining diameter of a coil C1 formed from the rod W wound around the uncoiler 2.

The first photoelectric sensor S1 and the second photoelectric sensor S2 each comprise a light emitting part and a light receiving part spaced by a prescribed distance and facing each other. The first photoelectric sensor S1 is installed at the exit of the uncoiler 1 through which the rod W is passed, the light emitting and light receiving parts being disposed facing each other across the passage of the rod W. When the tail end portion of the rod W has passed allowing the light from the light emitting part to reach the light receiving part, a signal is issued that signifies that the tail end of the rod W has passed. On the other hand, the light emitting and light receiving parts of the second photoelectric sensor S2 are disposed on a line that is parallel to a line tangent to the circumference of the coil C1 at a point taken at a prescribed distance axially outward from the center of the coil C1 formed from the rod W wound on the uncoiler 2. When the diameter of the coil C1 is reduced below a predetermined dimension allowing the light from the light emitting part to reach the light receiving part, a signal is issued that signifies that the remaining amount of the rod W is low. The first photoelectric sensor S1 is used when rewinding the rod W using the uncoiler 1, whereas the second photoelectric sensor S2 is used when rewinding the rod W using the uncoiler 2.

Figure 16:
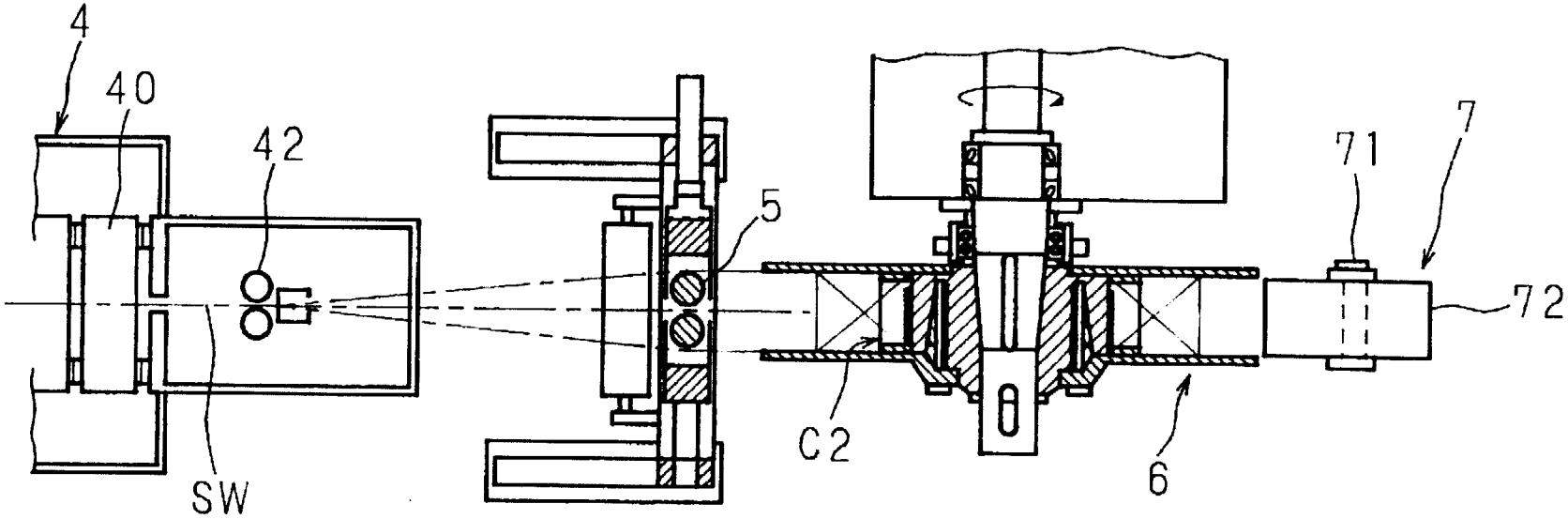
FIG. 16 is an enlarged plan view, with portions broken away, illustrating a pressure roller and its adjacent parts shown in FIG. 14.
Figure 17:
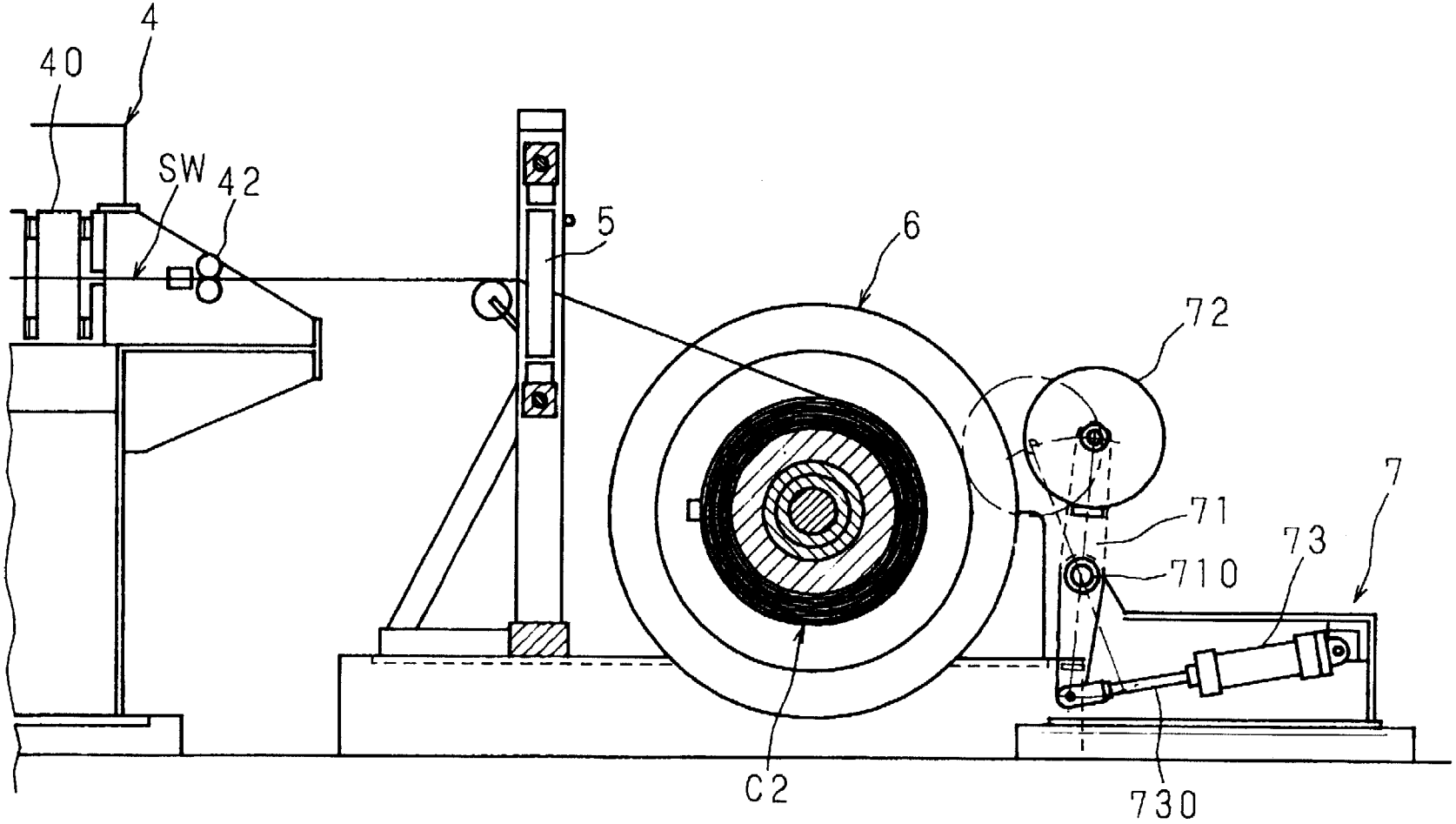
FIG. 17 is an enlarged side view, with portions broken away, illustrating the pressure roller and its adjacent parts shown in FIG. 15.

On the downstream side of the coiler 8 and adjacent to it, there is disposed a pressure roller device 7 for pressing a coil C2 of wire SW wound on the coiler 6 in order to prevent the coil C2 from unwinding when the rolling operation by the continuous rolling mill 4 is completed. The construction of the pressure roller device 7 will be described below with reference to FIGS. 16 and 17.

The pressure roller device 7 comprises a pressure roller 72 installed on one end thereof. An arm 71 mounted pivotably about a horizontal shaft 710 in a vertical plane perpendicular to the floor surface is operated by a telescopic rod 730 of an air cylinder 73; the arm 71 is turned to apply or release pressure on the coil C2 of the wire SW wound around the coiler 8. Thus, the pressure roller device 7 presses the pressure roller 72 against the coil C2 to prevent it from unwinding. The width of the pressure roller 72 is chosen to be large enough to ensure the pressing on the tail end of the wire SW which can be at any point along the widthwise direction of the coil C2, but about 1 mm smaller than the width of the bobbin of the coiler 6 so as not to touch the side plates of the reel thereof. Furthermore, the outer circumferential surface of the pressure roller 72 is lined with polyurethane rubber to prevent the wire SW from being flawed.

Usually, in rod rolling mill, rods are first rolled hot and then cooled while being transported on a line table; the rods are then delivered to a carrier and coiled in horizontal winding. For such a rod coil, the horizontal uncoiler 1 is used. On the other hand, for a rod coil wound on a bobbin orderly, the vertical uncoiler 2 is used. With the rolling line shown in FIGS. 14 and 15, when two or more series of wire rolling are performed, the horizontal uncoiler 1 is used for the first series, and for the second and subsequent series of rolling, the vertical uncoiler 2 is used, since the wire is wound on the vertical coiler 6 orderly as a result of the first series of rolling. Rewinding the orderly wound coil C1 using the vertical uncoiler 2 makes it possible to roll the wire at high speed. Therefore, when two or more series of rolling are performed, the first series of rolling is performed at slow speed, and since it is desirable that the second and subsequent series of rolling be performed at a higher speed for higher production efficiency, the horizontal uncoiler 1 and the vertical uncoiler 2 are provided in the present embodiment as described above.

Figure 18:
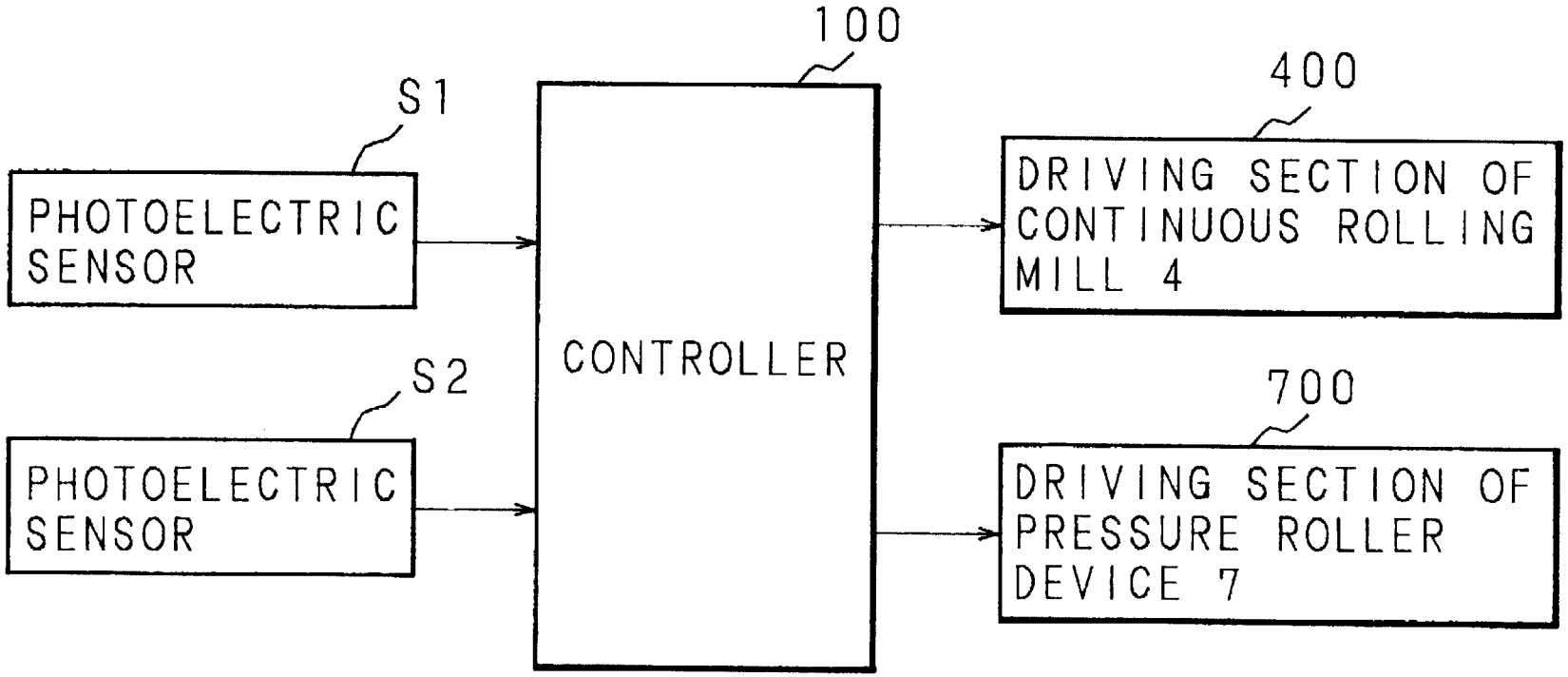
FIG. 18 is a block diagram of a control system according to the fourth embodiment.

In FIG. 18 showing the control system of this embodiment, the reference numeral 100 indicates a controller for performing various controls in the production of wire. The detection signals from the first and second photoelectric sensors S1 and S2 are supplied to the controller 100. Based on the detection signals supplied from the first and second photoelectric sensors S1 and S2, the controller 100 performs the processing to be described hereinafter and gives control signals to a driving section 400 of the continuous rolling mill 4 and a driving section 700 of the pressure roller device 7 to control the driving of the continuous rolling mill 4 and the pressure roller device 7.

Figure 19:
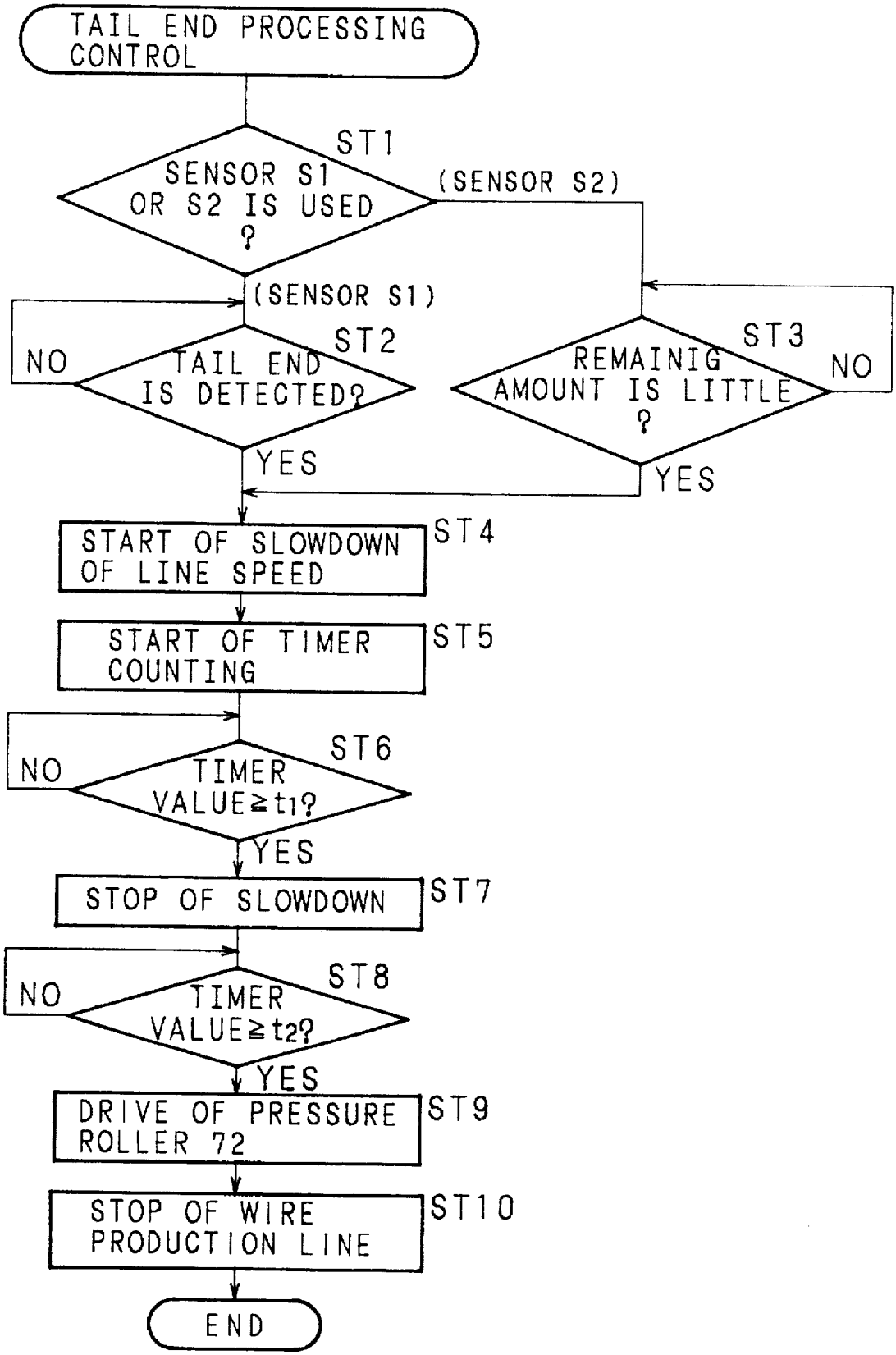
FIG. 19 is a flowchart showing a control procedure according to the fourth embodiment.

Referring now to the flowchart of FIG. 19, a procedure will be described below for the tail end processing control which is performed to prevent the wire SW wound on the coiler 6 from unwinding starting from the tail end of the coil C2.

First, it is determined which photoelectric sensor, the first sensor S1 or the second sensor S2, is used for the tail end processing control (step ST1). When it is determined in step ST1 that the first photoelectric sensor S1 is used, then it is determined whether the first photoelectric sensor S1 has detected the passing tail end of the rod W (step ST2), and the process proceeds to step ST4 hereinafter described only when it is determined that the tail end of the rod W has been detected. On the other hand, when it is determined in step ST1 that the second photoelectric sensor S2 is used, then it is determined whether the second photoelectric sensor S2 has detected the remaining amount of the coil C1 having decreased below a predetermined value (step ST3), and the process proceeds to step ST4 only when it is determined that the remaining amount of the coil C1 lower than the predetermined value has been detected.

In step ST4, the line speed of the continuous rolling mill 4 is caused to slow down at a predetermined deceleration rate. At the same time, the timer counting is started (step ST5). Thereafter, when the timer has counted a predetermined time t1 (step ST6), the deceleration of the line speed of the continuous rolling mill 4 is stopped (step ST7). After that, when the timer has counted a predetermined time t2 (step ST8), the pressure roller device 7 is driven to press the pressure roller 72 onto the coil C2 wound on the coiler 8 (step ST9). After the tail end of the wire SW is issued from the continuous rolling mill 4, the wire production line is stopped (step ST10).

Figure 20:
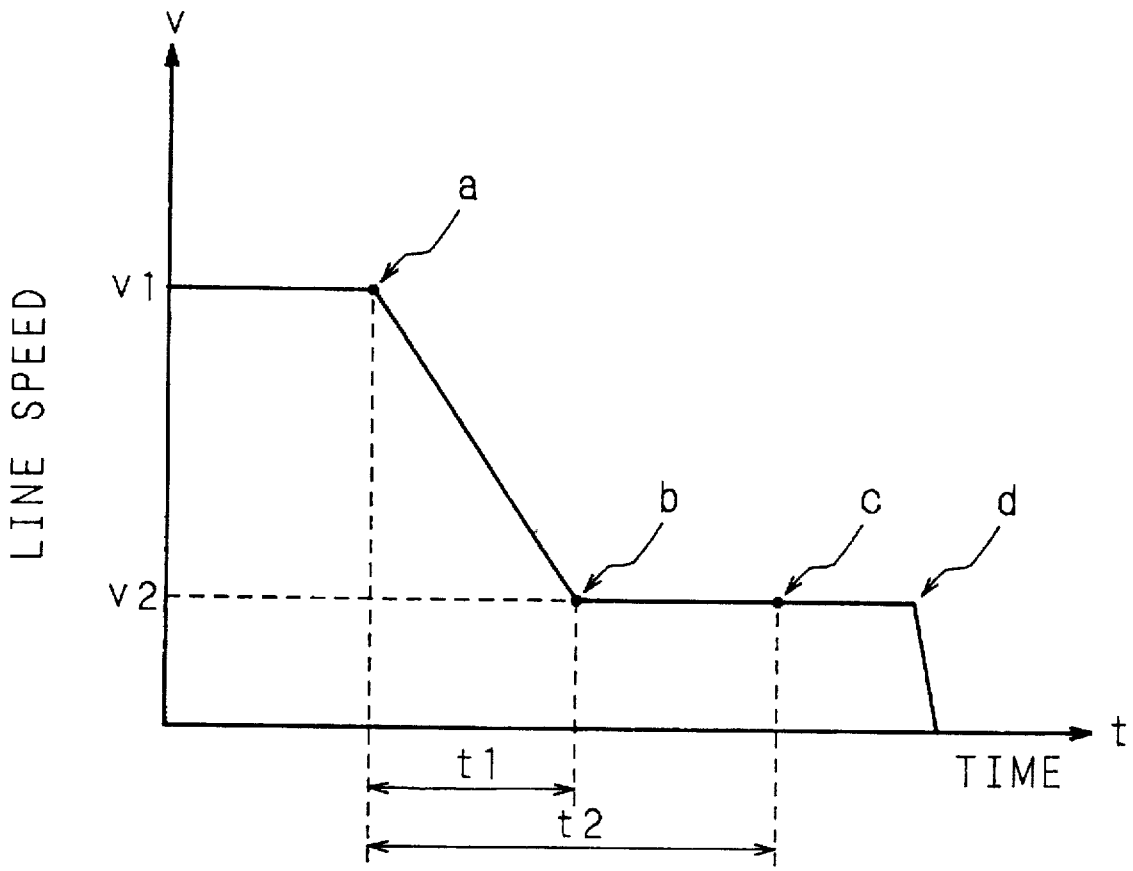
FIG. 20 is a graph showing the change of the rolling speed according to the fourth embodiment.

The following describes how the rolling speed is changed by the tail end processing control performed in the above procedure. FIG. 20 is a graph showing the change of the line speed by the tail end processing control, the line speed v being plotted along the ordinate as a function of the time t plotted along the abscissa. After the initiation of the rolling operation, the continuous rolling mill 4 performs rolling with a first line speed v1. In the case of slow speed rolling, the deceleration of the line speed is started (at point a in FIG. 20) when the first photosensor S1 has detected the passing tail end of the rod W; on the other hand, in the case of high speed rolling, the deceleration of the line speed is started (at point a) when the second photoelectric sensor S2 has detected the remaining amount of the coil C1 having decreased. The deceleration is performed at a constant deceleration rate. When the timer has counted the time t1 (at point b), the deceleration of the line speed is stopped, after which the rolling is performed with a constant second line speed v2. When the timer has counted the time t2 (at point c), the pressure roller 72 is pressed onto the coil C2, while the rolling is continued with the second line speed v2. When the tail end of the wire SW is issued from the continuous rolling mill 4 (at point d), the production line is stopped.

The following describes actual examples of wire production performed using two different sets of production conditions.

In the first example, the production conditions were set as follows: uncoiler—horizontal uncoiler (laying coil); coiler—vertical coiler (orderly winding); rod—SUS304 of 4 mm diameter; outer diameter of wound coil—600 to 800 mm; line speed—4.0 m/s; and winding tension—60 to 100 kg. With these production conditions, the following three productions were carried out: the first production, as a comparative example, wherein the pressure roller device was not used; the second production wherein the pressure roller device was manually operated by an operator; and the third production wherein control was performed in such a manner that upon detecting the tail end of the rod at the exit side of the uncoiler, the line speed was reduced at a deceleration rate of 0.3 $m/s^2$ for five seconds at the end of which period the pressure roller device was put into operation. In the first production, the coil on the coiler became unwound starting from the tail end thereof at the completion of the rolling, thus disarraying the orderly winding and causing flaws on the unwound wire by chafing against the surrounding parts. In the second production, the operator operated the pressure roller device at the completion of the rolling, which successfully prevented the tail end of the coil from unwinding from the coiler, thus maintaining the orderly winding of the coil. However, when the same production was repeated many times, the operator failed to operate properly from time to time, in which case the coil became unwound starting from the tail end thereof. In the third production, the tail end of the coil was successfully prevented from unwinding from the coiler, and the orderly winding of the coil was maintained. Furthermore, there was not a single case of the tail end of the coil becoming unwound even when the same production was repeated many times.

Next, in the second example, the production conditions were set as follows: uncoiler—vertical uncoiler (orderly multiple winding); coiler—vertical coiler (orderly multiple winding); rod—SUS304 of 4 mm diameter; outer diameter of wound coil—600 to 800 mm; line speed—10.0 m/s; and winding tension—15 to 25 kg. With these production conditions, the following two productions were carried out: the fourth production wherein control was performed to operate the pressure roller device with the same timing as in the third production; and the fifth production wherein control was performed in such a manner that upon detecting the remaining amount of the coil on the uncoiler having reached 30 mm, the line speed was reduced at a deceleration rate of 0.3 $m/s^2$ for 25 seconds, and upon one minute having elapsed after the detection, the pressure roller device was put into operation. In the fourth production, since the line speed was fast, there occurred a delay in operating the pressure roller device, as a result of which the coil became unwound starting from the tail end thereof. Furthermore, since the coil was heated to about 300° C. as a result of the high speed rolling, heat damage was caused to the pressure roller lined with polyurethane rubber. On the other hand, in the fifth production, the tail end of the coil was successfully prevented from unwinding and the orderly winding of the coil was maintained. There was not a single case of the coil becoming unwound even when the same production was repeated many times. Furthermore, since the slow speed rolling section was provided where the rod neared its tail end, the heat damage to the pressure roller, as mentioned above, was successfully avoided.

As described above, according to the fourth embodiment, the pressure roller device 7 is operated to press the roller onto the coil C2 of the wire SW wound on the coiler 6 with the timing related to the rolling of the tail end of the rod W being completed in the rolling line; therefore, the tail end of the wire SW is prevented from unwinding from the coil C2 at the completion of the rolling. Furthermore, since the pressure roller device 7 is operated to press the coil C2 after the rolling line speed has been reduced to a predetermined speed, unnecessary abrasion between the pressure roller 72 and the coil C2 is avoided.

(Embodiment 5)

Figure 21:
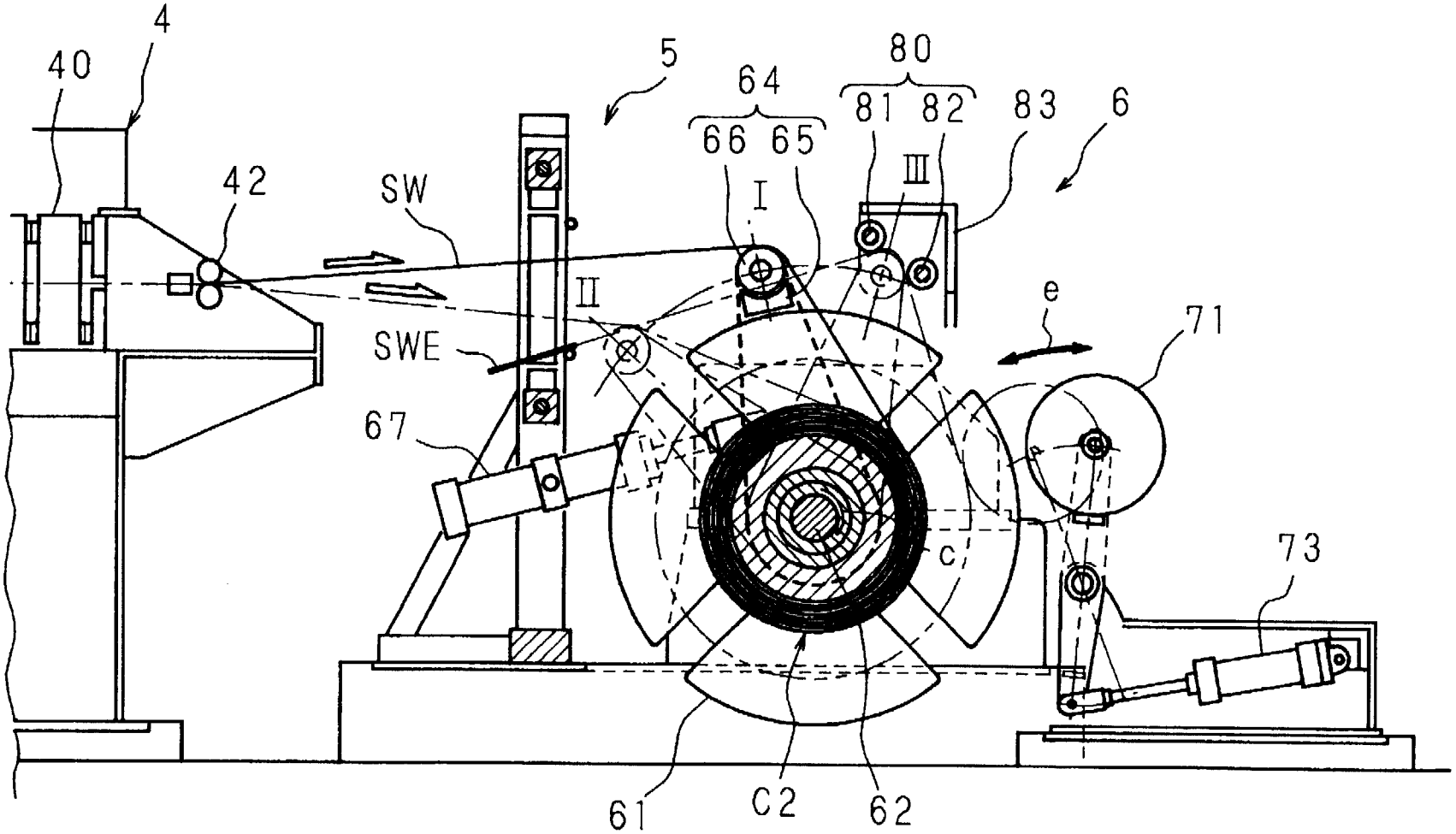
FIG. 21 is a side view of a coiler in a wire producing apparatus according to a fifth embodiment of the present invention.
Figure 22:
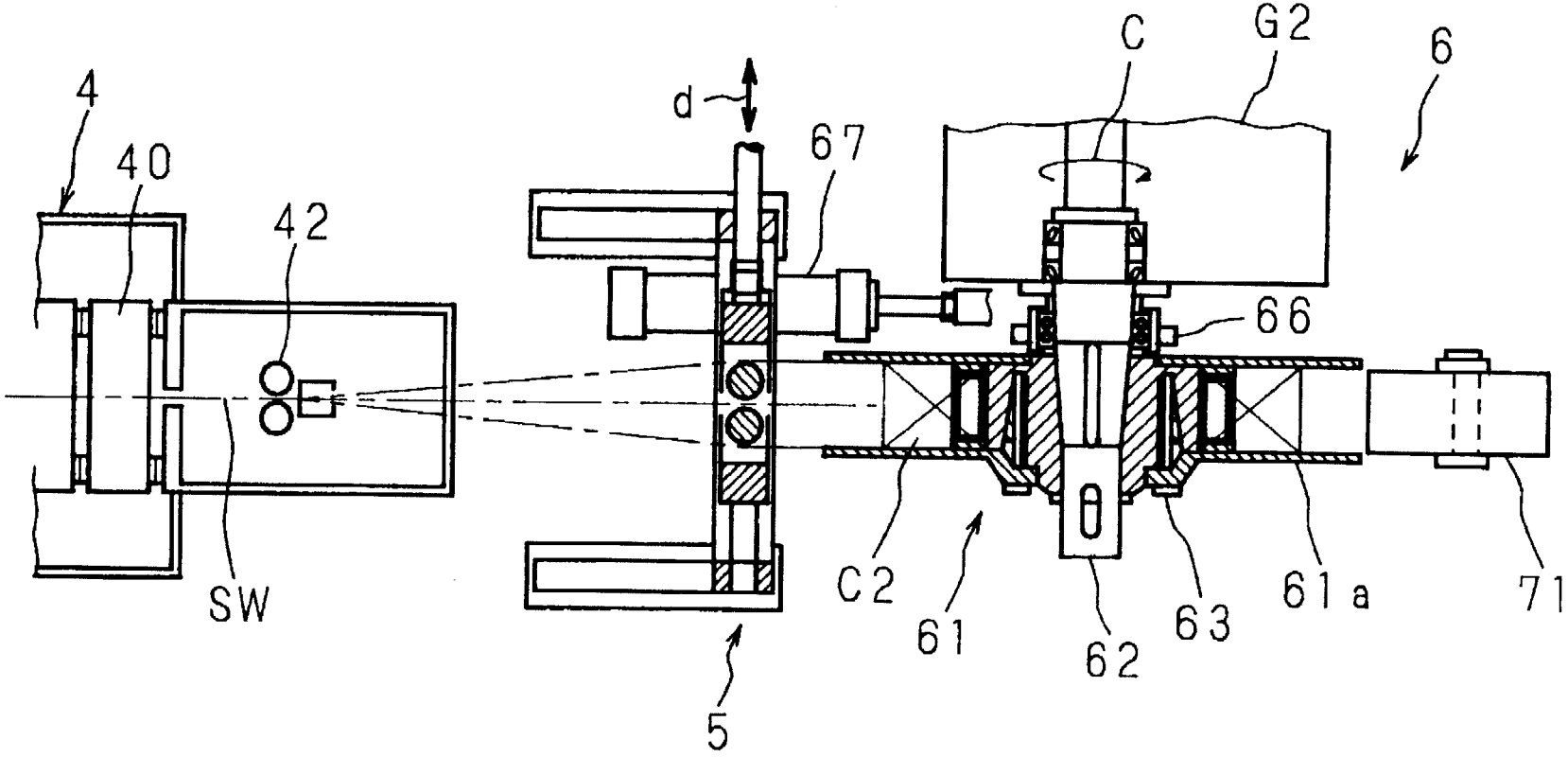
FIG. 22 is a cross sectional view showing the essential portions of the coiler in the fifth embodiment.

FIGS. 21 and 22 are a side view and a plan view respectively, illustrating a coiler 6 and its adjacent parts in a fifth embodiment of the invention. In the figures, the reference numeral 4 indicates a continuous rolling mill constructed from a plurality of four-roll stands arranged in tandem, and the numeral 42 designates an exit guide roller thereof. The coiler 6 includes a takeup reel 61 mounted on a drive shaft 62. The drive shaft 62 is connected to a motor (not shown) via a gear reducer G2 so that the takeup reel 61 is rotated in the arrow direction c with a constant winding torque. The takeup reel 61 has a detachable front side panel 61*a* which is detached by removing a bolt 63 to allow the removal of a completed coil C2 of wire SW.

A swing roller 5 mounted in upright position on the upstream side of the coiler 6 is movable in both directions indicated by the arrow d across the width of the takeup reel 61 so that the wire SW is wound on the takeup reel 61 in orderly winding. Provided on the downstream side of the coiler 6 is a pressure roller 71 which is moved in the arrow direction e by an air cylinder 73; the pressure roller 71 is pressed onto the coil C2 just before the completion of the winding, to prevent the coil C2 from unwinding.

The coiler 6 also includes a tensioner 64 and a bending roller unit 80. The tensioner 64 comprises an arm 65 and tension roller 66 mounted on one end of the arm 65. The base end of the arm 65 is mounted concentrically on the drive shaft 62. The arm 65 is connected to an air cylinder 67 which is extended or contracted to move the tension roller 66 to a bending position indicated by reference sign III or to a tension application position indicated by reference signs I–II. During orderly winding operation, low pressure air is supplied to the air cylinder 67 so that the air cylinder 67 is normally urged in the extending direction. When the tension of the wire SW increases excessively, the air within the air cylinder 67 is compressed to contract the air cylinder 87 thereby absorbing the excessive tension. Thus, the tension roller 68 is moved between the positions I and II to apply optimum tension to the wire SW. By supplying high pressure air to the air cylinder 67, the tension roller 68 can be moved to the bending position III.

Figure 23:
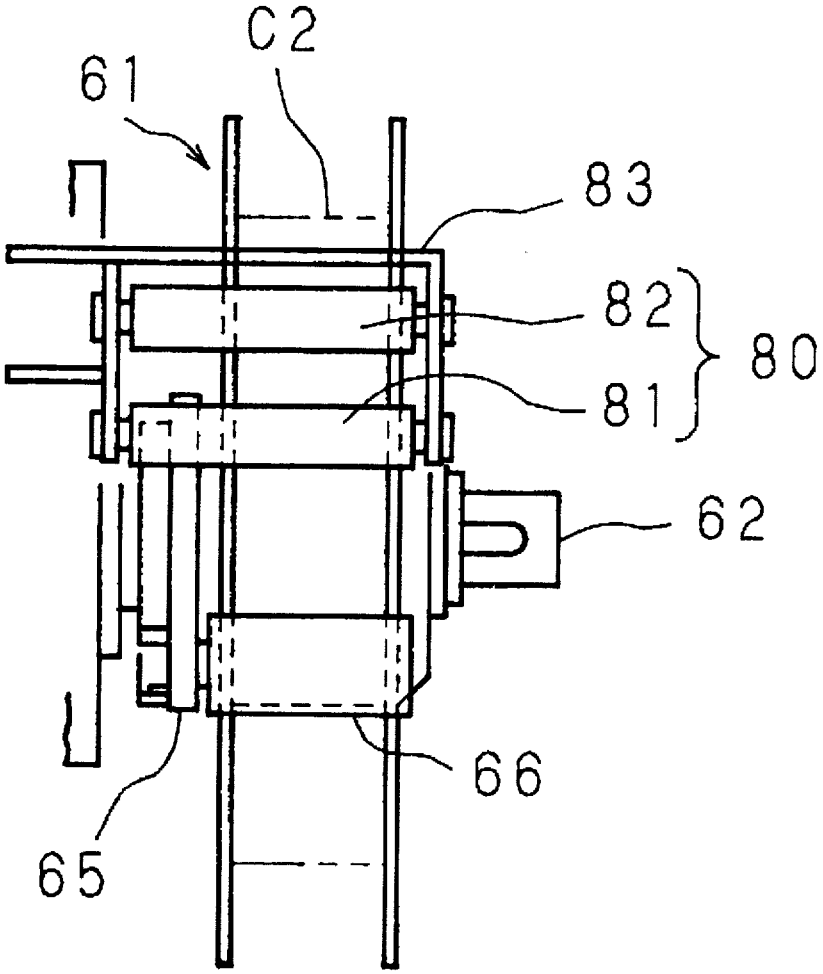
FIG. 23 is a plan view of a bending roller unit shown in FIG. 21.

The bending roller unit 80 is composed of two bending rollers 81 and 82, as shown in FIGS. 21 and 23, with their axes of rotation being parallel to the drive shaft 62 of the takeup reel 61. The bending roller unit 80 is mounted on a mounting plate 83 at a position near the peripheral surface of the takeup reel 61 and at which the tension roller 66 is pressed against the bending rollers 81 and 82; therefore, when the air cylinder 67 is extended to press the tension roller 66 against the two bending rollers 81 and 82, the wire SW being passed therethrough is subjected to the bending force.

Figure 24:
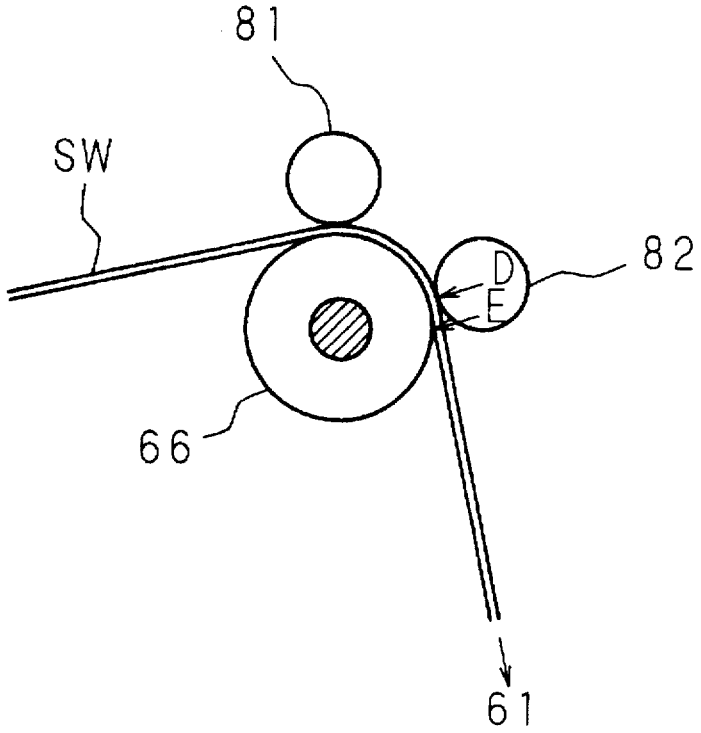
FIG. 24 is a diagram illustrating a desirable arrangement of bending rollers in the fifth embodiment.
Figure 25:
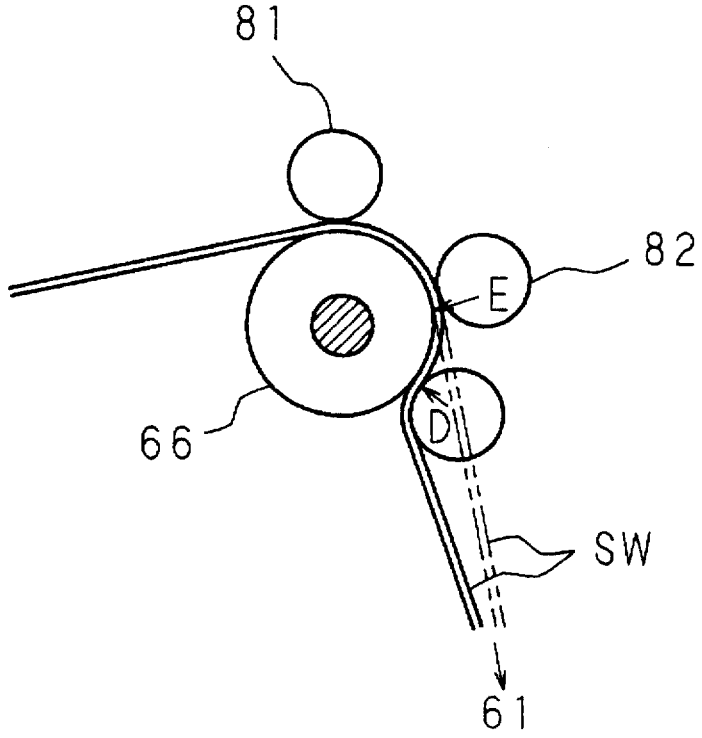
FIG. 25 is a diagram illustrating an undesirable arrangement of bending rollers in the fifth embodiment.

The bending rollers 81 and 82 must be mounted in relative relationship to the takeup reel 61 as shown in FIG. 24. When the point of contact between the tension roller 66 and the wire SW being taken up by the takeup reel 61 is denoted as E and the point of contact between the tension roller 66 and the bending roller 82 as D, the point of contact E must always be positioned downstream of the point of contact D, as shown in FIG. 24; if the point of contact D is positioned downstream of the point of contact E, as shown in FIG. 25, the wire SW will be bent in the opposite direction. As long as the above positional relationship is satisfied, the bending rollers 81 and 82 may be positioned as desired relative to the tension roller 66.

The following describes the winding and tail end processing of the wire SW according to this embodiment.

Prior to the initiation of winding operation, the air cylinder 67 is extended to move the tension roller 66 to the tension application position indicated by the reference signs I–II to apply tension to the wire SW. Since an adjustable low pressure air is supplied to the air cylinder 67, suitable tension is applied to the wire SW so that the wire SW is wound on the takeup reel 61 in orderly winding.

When the tail end of the wire SW is detected at the exit of the continuous rolling mill 4, the pressure roller 71 and the tensioner 64 are operated for the tail end processing on the coiler 6. That is, the air cylinder 73 is contracted to press the pressure roller 71 onto the coil C2 at the same time that high pressure air is supplied to the air cylinder 67 to extend it thereby causing the tension roller 88 to be pressed against the two bending rollers 81 and 82 (at the position indicated by III). In this situation, the wire SW is passed through while being pressed between the tension roller 66 and the bending rollers 81, 82, as a result of which the portion of the wire SW from the bending start position to its tail end SWE is formed under plastic deformation into a curved shape that matches the surface curvature of the coil C2. With this tail end SWE, the coil C2 can be finished into an orderly wound shape. In conventional equipment, upon exiting from the guide roller 42 of the continuous rolling mill 4, tension is released on the wire SW, but in this embodiment, since the tension, if slight, is maintained until the tail end SWE exits from the bending roller unit 80, the winding shape of the outermost layer is prevented from being disarrayed.

Figure 26:
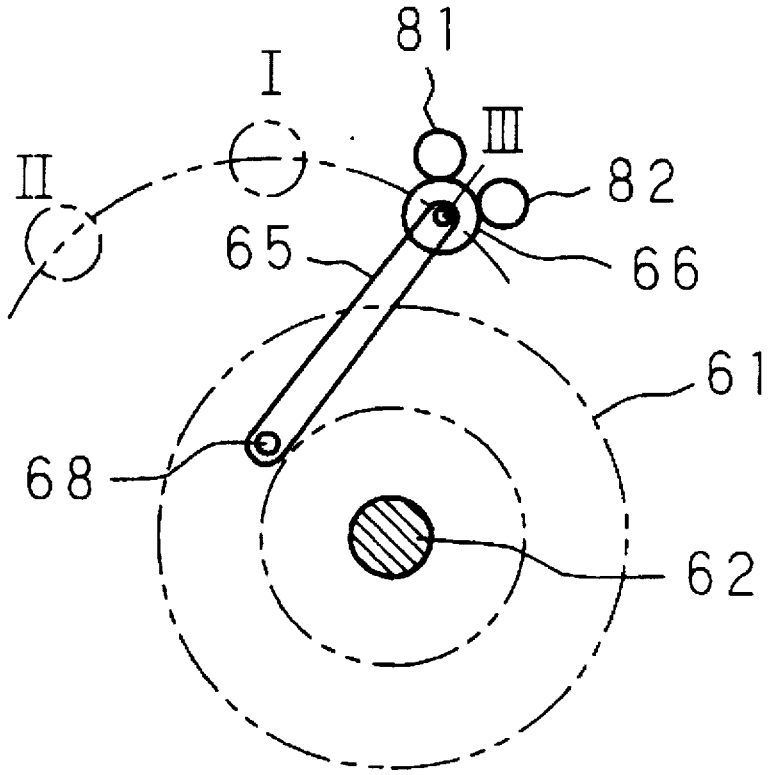
FIG. 26 is a diagram illustrating an alternative construction of a tensioner in the fifth embodiment.

A modification of the fifth embodiment is now described. In the above embodiment, the arm 65 of the tensioner 64 is mounted concentrically on the drive shaft 62, but alternatively, the base end of the arm 65 may be pivotably mounted with a pin 68 or the like at a position distanced from the drive shaft 62, as shown in FIG. 26. In this modification also, the tensioner can serve the purpose intended in the above embodiment if the position of the tension roller 66 can be switched between the tension application and bending positions.

Figure 27:
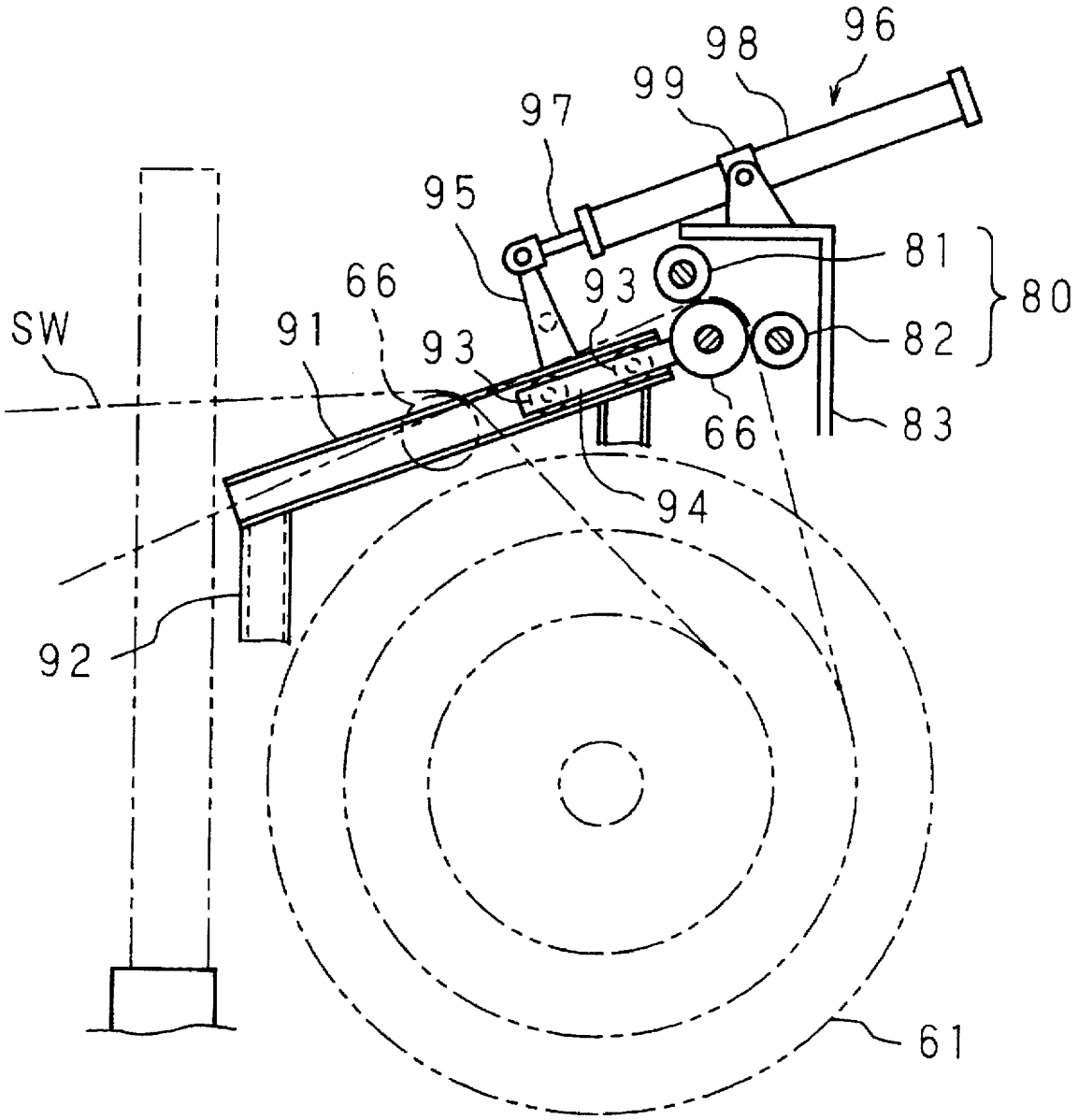
FIG. 27 is a diagram illustrating a further alternative construction of the tensioner in the fifth embodiment.
Figure 28:
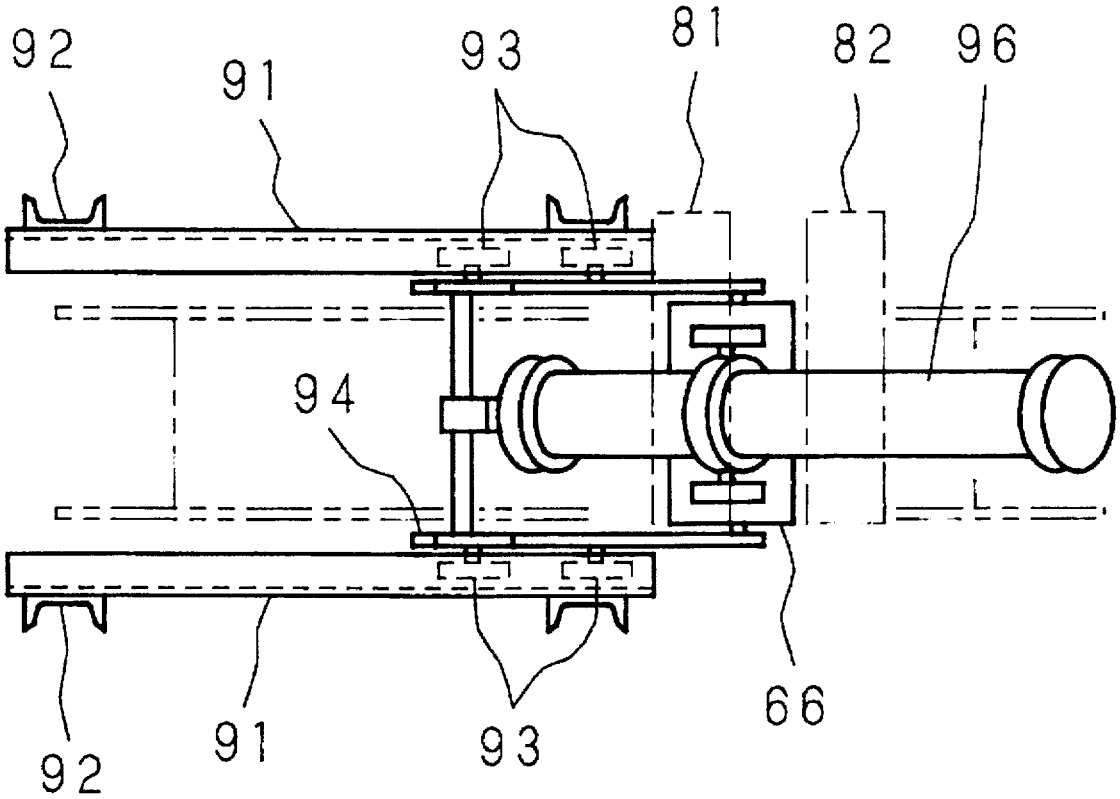
FIG. 28 is a plan view of the tensioner of FIG. 27.
Figure 29:
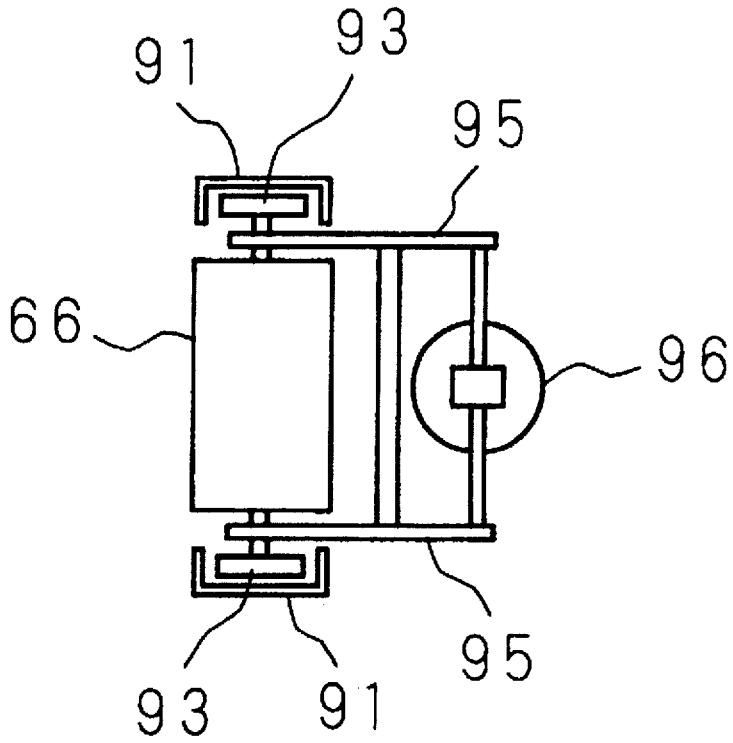
FIG. 29 is a cross sectional view of the tensioner of FIG. 27.

FIGS. 27 to 29 show a further alternative construction of the tensioner. The reference numeral 91 indicates a guide rail which is supported at an angle on a post 92 and is positioned above the takeup reel 61. Guide rollers 93 are moved rolling along the guide rail 91. Attached to the guide rollers 93 is a bar 94 on the opposite end of which is rotatably mounted the shaft of the tension roller 66. The bar 94 is connected by a stay 95 to a rod 97 of an air cylinder 96 which has a cylinder tube 98 fixed by a trunnion 99 to the mounting plate 83 of the bending roller unit 80. The guide rail 91 is straight in shape, but it may be in a curved shape. In the example shown, while the air cylinder 96 is extended to move the tension roller 66 to the position indicated by the dashed line, low pressure air is applied to urge the air cylinder 98 in the contracting direction to match the wire tension so that optimum tension can be applied to the wire SW. When the air cylinder 96 is contracted by applying high pressure, as shown by the solid line, the tension roller 66 is pressed against the bending rollers 81 and 82 to bend the wire SW.

As described above, according to the fifth embodiment, the wire SW is wound on the takeup reel 61 with the tail end thereof following the curvature of the coil C2 without leaping.

As this invention may be embodied in several forms without departing from the spirit of essential characteristics thereof, the present embodiments are therefore illustrative and not restrictive, since the scope of the invention is defined by the appended claims rather than by the description preceding them, and all changes that fall within metes and bounds of the claims, or equivalence of such metes and bounds thereof are therefore intended to be embraced by the claims.

What is claimed is:

1. An apparatus for rolling a rod as a stock material and producing a wire of 5 mm or smaller diameter, comprising:

a continuous rolling mill for rolling the rod, comprising a plurality of round-grooved four-roll stands arranged in tandem along a pass line, each roll stand including four-rolls defining a round groove center therebetween and each of the rolls having a round roll groove, wherein a bottom position of the roll groove is displaced between adjacent rolling stands by substantially 45 degrees relative to each other around the pass line;

a distance between the round groove center of adjacent rolling stands measured in a direction along the pass line is greater than 30 times and is not greater than 50 times an average diameter of the rod passing between the rolling stands;

mounting means for mounting thereon each of the rolling stands of said continuous rolling mill and movable with each rolling stand in a direction substantially perpendicular to the pass line; and moving means for moving said mounting means.

2. A wire producing apparatus as set forth in claim 1, wherein said continuous rolling mill includes at least one finishing four-roll stand.

3. A wire producing apparatus as set forth in claim 1, further comprising:

an uncoiler for unwinding a rod wound in a coil and feeding the rod to said continuous rolling mill; and a coiler for winding in a coil a wire obtained by rolling through said continuous rolling mill.

4. A wire producing apparatus as set forth in claim 3, further comprising:

pressing means for pressing the coil of wire wound on said coiler;

sensing means for sensing timing of when a coil diameter on said uncoiler is reduced below a predetermined dimension; and means for operating said pressing means in accordance with the timing sensed by said sensing means.

5. A wire producing apparatus as set forth in claim 1, wherein the distance between the round groove center of each adjacent pair of the rolling stands is no greater than 250 mm and the combination of the round roll groove of each of the rolls and the distance between the round groove center of each adjacent pair of the rolling stands prevents twisting of the rod as the rod travels downstream along the pass line.

6. A wire producing apparatus as set forth in claim 1, wherein the distance between the round groove centers of adjacent rolling stands at an outlet of the rolling mill is not greater than 50 times the average diameter of the rod passing through the adjacent rolling stands at the outlet.

7. An apparatus for rolling a rod as a stock material and producing a wire of 5 mm or smaller diameter, comprising:

a continuous rolling mill for rolling the rod, comprising a plurality of round-grooved four-roll stands arranged in tandem along a pass line and at least one finishing four-roll stand, each roll stand including four-rolls defining a round groove center therebetween and each of the rolls having a round roll groove, wherein a bottom position of the roll groove is displaced between adjacent rolling stands by substantially 45 degrees relative to each other around the pass line;

a distance between the round groove center of adjacent rolling stands measured in a direction along the pass line is greater than 30 times and is not greater than 50 times an average diameter of the rod passing between the rolling stands;

a common driving source for driving the rolling stands of said continuous rolling mill; and means for connecting and disconnecting a driving force of said driving source with respect to said at least one finishing stand.

8. An apparatus for rolling a rod as a stock material and producing a wire of 5 mm or smaller diameter, comprising:

a continuous rolling mill for rolling the rod, comprising a plurality of round-grooved four-roll stands arranged in tandem along a pass line, each roll stand including four-rolls defining a round groove center therebetween and each of the rolls having a round roll groove, wherein;

a bottom position of the roll groove is displaced between adjacent rolling stands by substantially 45 degrees relative to each other around the pass line; and a distance between the round groove center of adjacent rolling stands measured in a direction along the pass line is greater than 30 times and is not greater than 50 times an average diameter of the rod passing between the rolling stands;

an uncoiler for unwinding a rod wound in a coil and feeding the rod to said continuous rolling mill;

a coiler for winding in a coil a wire obtained by rolling through said continuous rolling mill;

a tensioner having a tension roller for applying tension to the wire being wound on said coiler;

two bending rollers disposed at a position near a peripheral surface of said coiler and at which said tension roller is pressed against the bending rollers; and driving means for moving said tension roller between a tension application position, where a constant tension is applied to the wire being wound, and a bending position where said tension roller is pressed against said bending rollers, wherein, just before the winding of a tail end portion of the wire, the tension roller is moved to the bending position to bend the tail end portion of the wire into a shape that matches a curvature of the coil.

9. A method of rolling a rod as a stock material and producing a wire of 5 mm or smaller diameter, comprising the steps of:

arranging a plurality of round-grooved four-roll stands in tandem along a pass line wherein each roll stand includes four grooved rolls defining a round groove center therebetween and each of the rolls has a round roll groove, a bottom position of the roll groove being displaced between adjacent rolling stands by substantially 45 degrees relative to each other around the pass line and a distance between the round groove center of adjacent rolling stands measured in a direction along the pass line being greater than 30 times and not greater than 50 times an average diameter of the rod passing between the rolling stands;

feeding a front end portion of the rod at slow speed into the plurality of rolling stands arranged in tandem, the front end portion being guided by a leading pipe to the round groove center, and winding the front end portion around a coiler;

setting a rotation speed of the grooved rolls of the plurality of rolling stands so that the rod will not slack during rolling through the plurality of rolling stands;

feeding the rod at high speed into the plurality of rolling stands without causing the rod to touch said leading pipe;

rolling the rod through the plurality of rolling stands to produce a wire; and winding the produced wire on said coiler.

10. A wire producing method as set forth in claim 9, wherein the plurality of rolling stands include at least one finishing stand and are driven by a common driving source in such a manner that all the rolling stands are driven together during a time that the front end portion of the rod is being fed while being guided by said leading pipe to the round groove center, until the front end portion is wound on said toiler, and thereafter a drive shaft of the at least one finishing stand is disconnected from said driving source and is allowed to rotate to roll the rod into a final size as the rod is passed therethrough.

11. A wire producing method as set forth in claim 9, wherein the plurality of rolling stands are clamped together by a clamping means, said clamping means being released, when changing a final rolled size of the rod.

12. A wire producing method as set forth in claim 9, wherein the wire wound on said toiler is pressed from an outer surface thereof in accordance with timing related to the rolling of a tail end of the rod being completed in the pass line.

13. A wire producing method as set forth in claim 9, wherein a timing at which a tail end of the rod passing a prescribed position in the pass line is detected, with which timing a rolling line speed is caused to slow down at a predetermined deceleration rate, and when the rolling line speed is reduced to a predetermined speed, the wire wound on said toiler is pressed from an outer surface thereof.

14. A wire producing method as set forth in claim 9, wherein while the rod is unwound from a coil wound on an uncoiler and fed into the plurality of rolling stands, a timing at which a diameter of the coil on said uncoiler decreasing below a predetermined dimension is detected, with which timing a rolling line speed is caused to slow down at a predetermined deceleration rate, and when the rolling line speed is reduced to a predetermined speed, the wire wound on said coiler is pressed from an outer surface thereof.

15. A wire producing method as set forth in claim 9, wherein the distance between the round groove center of each adjacent pair of the rolling stands is no greater than 250 mm and the combination of the round roll groove of each of the rolls and the distance between the round groove center of each adjacent pair of the rolling stands prevents twisting of the rod as the rod travels downstream along the pass line.

16. A wire producing method as set forth in claim 9, wherein the distance between the round groove centers of adjacent rolling stands at an outlet of the rolling stands is not greater than 50 times the average diameter of the rod passing through the adjacent rolling stands at the outlet.

* * * * *